US011654464B2

(12) United States Patent
Ernst De La Graete

(10) Patent No.: US 11,654,464 B2
(45) Date of Patent: May 23, 2023

(54) ROLLING METHOD WITH A STEP FOR ADJUSTING THE INTERSPACE BETWEEN THE LATERAL BACKUP ROLL AND THE SUPPORT ROLL

(71) Applicant: FIVES DMS, Noyelles-les-Seclin (FR)

(72) Inventor: Conrad Ernst De La Graete, Seclin (FR)

(73) Assignee: FIVES DMS, Noyelles-les-Seclin (FR)

( * ) Notice: Subject to any disclaimer, the term of this patent is extended or adjusted under 35 U.S.C. 154(b) by 0 days.

(21) Appl. No.: 16/976,864

(22) PCT Filed: Mar. 4, 2019

(86) PCT No.: PCT/FR2019/050483
§ 371 (c)(1),
(2) Date: Aug. 31, 2020

(87) PCT Pub. No.: WO2019/170994
PCT Pub. Date: Sep. 12, 2019

(65) Prior Publication Data

US 2020/0406323 A1 Dec. 31, 2020

(30) Foreign Application Priority Data

Mar. 5, 2018 (FR) ..... 18 51885

(51) Int. Cl.
*B21B 31/22* (2006.01)
*B21B 13/14* (2006.01)
*B21B 13/02* (2006.01)

(52) U.S. Cl.
CPC ..... *B21B 31/22* (2013.01); *B21B 13/145* (2013.01); *B21B 2013/025* (2013.01)

(58) Field of Classification Search
CPC ..... B21B 31/22; B21B 31/20; B21B 31/26; B21B 31/30; B21B 31/02; B21B 13/145;
(Continued)

(56) References Cited

U.S. PATENT DOCUMENTS 4,248,073 A * 2/1981 Verbickas ..... B21B 13/147 72/243.4
4,531,394 A * 7/1985 Turley ..... B21B 13/145 72/238
(Continued)

FOREIGN PATENT DOCUMENTS

EP 0 121 811 10/1984
EP 1 721 685 11/2006
(Continued)

OTHER PUBLICATIONS

International Search Report for PCT/FR2019/050483 dated Jun. 11, 2019, 5 pages.

*Primary Examiner* — Shelley M Self
*Assistant Examiner* — Teresa A Guthrie
(74) *Attorney, Agent, or Firm* — Nixon & Vanderhye

(57) ABSTRACT

Disclosed is a rolling method for rolling a strip including: rolling the strip by a pair of working rolls; transmitting a rolling force to the working rolls by a pair of support rolls; holding each of the working rolls by a pair of side support rollers; supporting each side support roller by two rows formed by rollers; supporting each row formed by the rollers, by a bearing support carrying rollers, the bearing support mounted pivotally on an articulation axis. The dimensions of a first interspace between the side support roller and the support roll and a second interspace between the strip and the assembly consisting of side support roller and bearing support vary in the course of the rolling. The method includes adjusting the dimension separating the axis of the support roll and the axis of the side support roller defining the first interspace.

9 Claims, 14 Drawing Sheets

(58) Field of Classification Search
CPC ..... B21B 2013/025; B21B 2013/028; B21B 2203/06; B21B 27/06; B21B 27/10; B21B 2027/103
USPC .... 72/10.7, 242.4, 241.2, 243.2, 243.4, 237, 72/201
See application file for complete search history.

(56) References Cited

U.S. PATENT DOCUMENTS

| | | | | |
|---|---|---|---|---|
| 5,193,377 | A * | 3/1993 | Sendzimir | B21B 13/147 72/241.4 |
| 6,041,636 | A | 3/2000 | Datzuk et al. | |
| 8,966,951 | B2 * | 3/2015 | Cronier | B21B 27/10 72/236 |
| 2012/0324973 | A1 * | 12/2012 | Charre | B21B 13/145 72/240 |

FOREIGN PATENT DOCUMENTS

| | | |
|---|---|---|
| EP | 2 391 459 | 12/2011 |
| EP | 2 464 470 | 6/2012 |
| WO | 2010/086514 | 8/2010 |
| WO | 2011/018126 | 2/2011 |
| WO | 2011/107165 | 9/2011 |
| WO | 2015/011373 | 1/2015 |

* cited by examiner

ROLLING METHOD WITH A STEP FOR ADJUSTING THE INTERSPACE BETWEEN THE LATERAL BACKUP ROLL AND THE SUPPORT ROLL

This application is the U.S. national phase of International Application No. PCT/FR2019/050483 filed Mar. 4, 2019 which designated the U.S. and claims priority to French Patent Application No. 18 51885 filed Mar. 5, 2018, the entire contents of each of which are hereby incorporated by reference.

BACKGROUND OF THE INVENTION

Field of the Invention

The invention relates to a rolling method adapted to a mill for rolling a strip, as well as to a rolling mill as such.

The field of the invention is that of the cold rolling of a metal strip, and more particularly that of rolling mills with a laterally supported sexto cage, and in particular rolling mills known by the term "Z High".

Description of the Related Art

These rolling mills find their application, in a line, for example in annealing and pickling lines or, off-line, as reversible rolling mills, for metal strips.

A quarto-cage rolling mill comprises a holding cage in which four rolls with parallel axes are provided, namely respectively two working rolls, top and bottom, defining the gap through which the strip to be rolled passes, and two support rollers, top and bottom, bearing respectively on the working rolls on the side opposite to that of the passage gap in order to transmit the rolling force.

A sexto rolling mill comprises two additional rolls compared with a quarto, namely two intermediate rolls interposed respectively between each working roll and the corresponding bearing roller, on either side of the metal strip: the clamping force of each bearing roller is transmitted to the working roll, only through the intermediate roll, the latter having a generatrix in contact with a generatrix of the bearing roller and a diametrically opposed generatrix in contact with a generatrix of the working roll.

In such rolling mills, each bearing roller and each intermediate roll is mounted rotatably at the ends thereof on chocks, by means of bearings, for example rolling bearings or hydrostatic bearings. These chocks are supports that can be moved in a vertical direction parallel to the clamping plane, along and between the two uprights of the cage.

Conventionally, balancing jacks allow movement of the chocks of the intermediate rolls. These balancing jacks make it possible to change the relative position of the chocks and of the roll thereof, making it possible among other things to open the cage in order to facilitate engagement of the product to be rolled, or to move these elements in order to facilitate removal of the rolls. These balancing jacks can also make it possible to camber the intermediate rolls.

One advantage of a sexto-cage rolling mill is the possibility of using, compared with a quarto cage, working rolls with a smaller diameter, which makes it possible to obtain a greater reduction in thickness of the product to be rolled, for the same rolling force.

A sexto rolling mill moreover offers the possibility of axially offsetting the two intermediate rolls, for the purpose of applying the rolling force only over the width of the strip to be rolled rather than over the entire length of the working rolls.

In a sexto rolling mill referred to as "laterally supported", very often the working rolls are not mounted on chocks, but on the other hand provided floating. It is then necessary to maintain the axial position thereof by means of axial stops, but also to maintain the lateral position thereof by means of lateral support members, such as lateral support wheels or rollers disposed on either side of the clamping plane.

There is known, for example, from the document EP 0 121 811, in particular from the embodiment in FIG. 2, such a sexto rolling mill that comprises two working rolls, two support rollers and two intermediate rolls, interposed respectively between one of the working rolls and the corresponding bearing roller. In this document, the working rolls, the intermediate rolls and the support rollers are all mounted on chocks.

Each working roll is supported laterally, on either side of the working roll, by two pairs of rollers. The rollers of the same pair are provided at the two ends of each working roll, at the ends of the roll that are not in contact with the strip to be rolled. The rollers are mounted in a pivot on forks able to move in translation with respect to the upright of the cage, under the action of hydraulic jacks.

In FIG. 6 of this document, nozzles are provided installed on the support part of the rollers, able to move with respect to the upright of the cage. For this purpose, hoses are used for supplying the nozzles with cooling and/or lubrication products, the hoses make it possible to take account of the movements between the support part, which is movable, and the uprights of the cage. These nozzles allow lubrication and cooling of the rollers and of the working roll, at the roller support zone.

Another design of rolling mill, of the laterally supported sexto type, is also known from the document U.S. Pat. No. 4,531,394. Such a rolling mill still comprises two working rolls, two support rollers and two intermediate rolls, interposed respectively between one of the working rolls and the corresponding bearing roller. In this document, the support rollers and the intermediate rolls are mounted at the ends thereof on chocks, while the working rolls are provided floating. Each working roll is supported laterally, on each side of the working roll, by a side support roller, itself bearing on two rows of rollers disposed over the length of the roll.

In this design of rolling mill, for each working roll, the two corresponding side support rollers are secured to the two chocks of said intermediate roll. Each side support roller, as well as the support rollers thereof, are mounted on a support arm that extends between the two chocks of the intermediate roll, each support arm being mounted so as to pivot about a shaft, the ends of which are secured to the chocks.

The assembly consisting of intermediate roll, intermediate-roll chocks, support arms (right and left), rollers and side support rollers, right and left, form a self-supporting assembly, normally referred to as a "cassette" or "insert", which can be introduced into the cage, or removed from the cage, during maintenance, by sliding the assembly in the direction of the rolls, in the open position of the cage.

Four force-distribution beams extend rigidly between the two uprights of the cage, respectively, facing each support arm. Each force-distribution beam supports a so-called preloading beam, able to move in translation with respect to the corresponding force-distribution beam, movable towards the inside of the cage in a substantially horizontal direction. Preloading jacks make it possible to force the movable beam in contact with the pivoting support arm in order to preload the side support roller on the working roll.

In such a rolling mill, the cooling and lubrication of the working roll and of the intermediate roll are effected by means of nozzles, marked respectively 73 and 72 in FIG. 2 of the document U.S. Pat. No. 4,531,394, physically at a distance from the working roll, situated outside the "insert" or the "cassette". In FIG. 2, these nozzles are secured to the force-distribution beam, or to the movable preloading beam. So that the jet can reach the intermediate roll, the nozzles referenced 72 are opposite bores passing through the support arms. In practice, and to the knowledge of the inventors, this solution of spraying the support arms by means of bores does not appear to be adopted in rolling mills used industrially.

According to the observations of the inventors, the spray nozzles referenced 73 are incapable of correctly cooling the working roll since they are situated too far away therefrom, the jets thereof coming to interfere too quickly with the lateral support arms and lateral support wheels and rollers and are therefore incapable of following the travel of the strip. Moreover, according to the observations of the inventors, the nozzles referenced 72 are incapable of correctly lubricating the contact between the working roll and the intermediate roll since they are situated too far away therefrom. In use, such rolling mills with insert have a limited service life for the working roll, because of the poor cooling thereof.

Another design of a laterally supported sexto rolling mill, with "insert" or "cassette", is also known from the document U.S. Pat. No. 6,041,636. As in the previous document, the assembly consisting of intermediate roll, intermediate-roll chocks, support arms (right and left), and lateral rollers and support rollers, right and left, forms a self-supporting assembly that can be introduced into the cage or removed from the cage during maintenance, by sliding of the assembly in the direction of the rolls.

In this document U.S. Pat. No. 6,041,636, the chocks of the intermediate rolls are mounted on Maes blocks. The jacks of the Maes blocks make it possible, in operation, to bring together the intermediate rolls, in a working position illustrated in FIG. 5 of this document, or to separate the intermediate rolls to a position, illustrated in FIG. 4, allowing removal of the inserts by sliding. These jacks can also make it possible, in operation, to camber the intermediate roll.

In this document, supplying lubricant to the bearings of the rollers of the arms supporting the insert, from a source of lubricant, is known. Connection/disconnection devices make it possible, in the working position of the rolls, to connect the source of lubricant to lubrication bores provided in the chocks, and to automatically disconnect the bores when the intermediate rolls and the chocks thereof are moved away vertically by the Maes blocks. This automatic connection/disconnection is advantageous. No additional operation for connecting/disconnecting the source of lubricant is necessary during maintenance, in particular when the inserts must be removed or introduced into the cage. For this purpose, each connection device comprises an element, referenced 57, called a "plunger", which is hollow, intended to conduct lubricant, and which makes it possible, in the working position of the intermediate rolls, as illustrated in FIG. 9, to join the bore of the chock in a relatively fluid-tight manner by means of a seal. This element is movable, vertically in translation, constrained towards its sealing position by means of a spring, referenced 58. In the connection position, the lubricant flows from the source of lubricant through the movable element as far as the bore of the insert. The lubricant next flows from the bore of the chock, as far as the bearings, by means of the hollow of the shaft, referenced 17, on which the support arm is pivotably mounted.

When the intermediate rolls are moved away by the Maes blocks as far as the retracted position thereof, the travel of the movable element is limited, less than the movement travel of the Maes blocks, thus guaranteeing an interspace between the movable elements and the chock, as illustrated in FIG. 8 of the document U.S. Pat. No. 6,041,636. It is then possible to remove the insert, without friction between the chocks and the movable element.

Such a connection/disconnection device allows lubrication of the bearings of the support arms. However, this document does not deal with the problem of cooling of the working rolls. To the knowledge of the inventors, and according to this design, the cooling of the intermediate and working rolls and the lubrication of the contact between intermediate roll and working roll is still effected by providing nozzles physically at a distance from the rolls.

However, from the document EP 1 721 685, a rolling mill of the laterally sexto type is known, improving the cooling of a working roll. This document proposes to improve the rolling mills of the prior art with "cassettes", for which there would be no space for placing the cooling nozzles as close as possible to the rolls. FIG. 2 illustrates the object of the improvement of the prior art document EP 1 721 685.

The rolling mill is now a unidirectional (non-reversible) rolling mill that comprises, upstream, in the direction of travel of the strip, a side support roller, as previously described, supported by a support arm. Downstream, the support arm has no bearing roller or roller. This bearing roller is replaced by a pad called a "support pad", which may be made from bronze or a self-lubricating graphite material, intended to slide on the surface of the working roll, without exerting any substantial force thereon.

This support arm with pad incorporates a plurality of nozzles for a cooling liquid that make it possible to directly cool the working roll, on the downstream side. Downstream, the lubricant liquid is supplied to the nozzles by means of the hollow shaft of the corresponding support arm. Upstream, the hollow shaft of the support arm is used to convey the lubricant to the bearings of the rollers supporting the side support roller. This document thus teaches how to improve the cooling of the working rolls. However, this improvement is done to the detriment of the supporting of the working roll on one of the sides thereof, by eliminating a side support roller and replacing it with a pad, the rolling mill then no longer being a reversible rolling mill.

A method and device for cooling a rolling mill is also known from the document EP 2 391 459. This document is concerned more particularly with the cooling of the working rolls each supported laterally by a pair of rolls, and comprising at least one pair of support rollers for transmitting a rolling force. This document sets out in particular to be an improvement to the document EP 1 721 685 previously described, a solution that would remain prohibited for reversible rolling mills.

According to this document, a direct spraying of at least part of the working rolls is provided, on either side of said plane perpendicular to the direction of travel of the strip. According to this document, the nozzles are positioned on the supports of the side support rollers, in order to directly cool the working roll on both sides, laterally on either side of the clamping plane.

However, the document described in this document EP 2 391 459 is not a "cassette" technology as taught by the documents U.S. Pat. Nos. 4,531,394, 6,041,636, EP 1,721, 685, for which the assembly consisting of intermediate roll, chocks of the intermediate roll, support arm (right and left) and lateral rollers and support rollers, right and left, form a self-supporting assembly, referred to as an "insert" that can be introduced into the cage or removed from the cage during maintenance, by sliding of the assembly in the direction of the rolls.

The real difficulty in improving the cooling of the working rolls in a cassette-type rolling mill is not placing the cooling nozzles in the cassette, but knowing how to supply them with lubrication/cooling fluid, and without increasing the maintenance time during operations of removal or insertion of the cassette in the cage of the rolling mill For example, it is not possible to use hoses between the cassette and the cage of the rolling mill to supply the nozzles since these would require being removed and replaced during operations of removing or introducing the cassette, which would considerably extend the time necessary for these maintenance operations.

As previously described, the document U.S. Pat. No. 6,041,636 discloses automatic connection devices making it possible, in the working position of the rolls, to connect the source of lubricant to lubrication bores provided in the chocks, and to automatically disconnect the bores when the intermediate rolls are moved away vertically by the Maes blocks. However, such a device can be used only for supplying lubricant, either solely to the bearings of the rollers of the side support roller of a support arm, or solely for supplying fluid to the nozzles of a support arm. This is the reason why the support arm of the nozzles has no side support roller in the document EP 1 721 685, this being replaced by a pad that does not require a bearing to be lubricated. Moreover, the connection device of this prior art is connected to the chocks, which makes it necessary to convey the fluid on a complex path by means of the hollow shaft and as far as the bottom end of the support arm. This complex path of the fluid, from the chock to the support arm, by means of the hollow shaft, gives rise to significant pressure drops, limiting the flows.

In summary, and according to the aforementioned prior art, in the aforementioned reversible rolling mills of the laterally supported sexto type, with cassettes, the cooling of the working rolls and intermediate rolls is carried out by means of nozzles placed outside the cassette, physically at a distance from the working rolls and the intermediate rolls, and the jets of which cannot directly reach the working rolls. In this type of rolling mill used industrially, it is conventional to place a spray manifold on each side of the clamping plane installed on the force-distribution beam of the cage and the jets of which are directed at the contact between the bearing roller and the intermediate roll.

According to this arrangement, the lubrication of the working roll is therefore obtained, indirectly, by the fact that the intermediate roll has been wetted and this roll transports this lubrication when it rotates by a half turn, to the working roll. According to the observations of the inventors, this lubrication is insufficient, in particular for the rolls placed under the strip.

Furthermore, and when the speed of the rolling mill becomes high, the centrifugal force at the circumference of the intermediate roll tends to dry the roll so that little cooling fluid reaches the working roll.

However, from the document WO 2015/011373 of the present applicant, a rolling mill of the supported sexto type is known, with cassette technology, which provides appreciable progress for the cooling of the working rolls, and compared with the aforementioned prior art, in particular of a rolling-mill cage with cassette.

It is a laterally supported sexto rolling mill that includes:

- a holding cage comprising two pairs of uprights separated from each other at the two ends of the cage, at least two uprights in the same pair defining an access window,
- two working rolls, able to grip a strip to be rolled, two support rollers, and two intermediate rolls, the support rollers and intermediate rolls being mounted rotatably at the ends thereof on chocks,
- side support rollers, able to support the working rolls laterally, each side support roller being carried by a support arm, mounted pivotally on a shaft,
- force-distribution beams extending between the corresponding uprights of each pair, and means for applying a preloading force on each support arm, intended to engage with one of the support arms at a bearing surface, and comprising at least one preloading jack secured to one of the force-distribution beams,
- one or more spray nozzles for a lubricating/cooling fluid.

Each support arm of a side support roller is mounted pivotally on said shaft, consisting of a shaft secured to the chocks of one of the intermediate rolls, each intermediate roll, chocks of the intermediate roll, side support rollers and corresponding support arms forming a self-supporting assembly, referred to as an insert (or "cassette"), which can be removed or introduced by sliding through the access window during maintenance, in the open position of the cage.

The hollow of the shaft may optionally serve, as in the prior art (see U.S. Pat. No. 6,041,636) to channel a fluid intended to lubricate the bearings of the rollers (referenced 52 in FIG. 1) laterally supporting the side support roller. According to the document WO 2015/011373, at least one of the nozzles is installed on one of the support arms, in particular to allow lubrication/cooling of the working rolls and/or of the intermediate rolls.

Advantageously, the circuit supplying fluid to said at least one nozzle comprises a connection/disconnection device referenced 13, having:

- a pipe of the support arm, intended to channel the fluid, having a supply opening emerging on the bearing surface 10 of the support arm 6 intended to engage the means for applying a preloading force,
- a hollow part, movable with respect to the force-distribution beam, movable with respect to said force-distribution beam 8 under the action of said means 9 for applying a preloading force.

According to the document WO 2015/011373, this hollow part is configured to make a sealed connection with the supply opening on the bearing surface in a first connection position, or on the contrary to retract into a second disconnection position, at a distance from the bearing surface.

In the first connection position, as illustrated in FIG. 2 of the document WO 2015/011373, the cooling fluid can be channelled from the source as far as said at least one nozzle referenced 12 (illustrated) or as far as said at least one nozzle referenced 12' (not illustrated), by means of said connection/disconnection device.

In the second disconnection position, the means for applying a preloading force are withdrawn, in a retracted position, said hollow part being at a distance from the support arm.

This position makes it possible, in particular when the design of the rolling mill is of the type with insert (or with a cassette), to be able to withdraw or introduce the insert, without requiring any additional maintenance time for connecting/disconnecting the fluid source.

Another advantage of such a connection/disconnection device is that it is directly connected to the support arm, rather than to the chocks of the intermediate roll as taught in the prior art known from the document U.S. Pat. No. 6,041,636. To arrive as far as the nozzle or in a rolling mill of the type with insert WO 2015/011373, the fluid does not need to pass through the hollow shaft on which the support arm is pivotally mounted. It is then possible to substantially limit the pressure drops, and thus to obtain fluid flows much superior to those obtained in this prior art, and thus to substantially improve the cooling of the working rolls by placing the cooling nozzles as close as possible to the side support roller.

A rolling-mill cage of the laterally supported sexto type, with working rolls and intermediate rolls, is also known from the document WO 2011/107165. The rolling-mill cage comprises, according to the example in FIG. 5 of the side support rollers, and more particularly for each working roll, a first side support roller and a second side support roller, situated on either side of the clamping plane. Each side support roller is held by two rows of support rollers, the support rollers and the side support roller being carried by an arm mounted so as to pivot about a guide member referenced 72 in FIG. 5.

Remarkably, and in this document WO 2011/107165, the support rollers and their support arms are mounted so as to pivot on the Maes block, able to support a chock of the intermediate roll, a Maes block that is able to move vertically with respect to the upright of the cage. During maintenance, it becomes possible to extract the intermediate roll axially, by sliding its chocks with respect to the Maes blocks, and then for the side support roller to remain fixed in the cage, still connected to the Maes block by means of the support arms.

The invention relates more particularly, at least according to one embodiment, to the problem of cooling the working rolls, when each working roll is held laterally, by two rolls of a pair of side support rollers, disposed on either side of the clamping plane, by a direct spraying of the working roll, and as taught by the document EP 291 459 A1.

Remarkably, however, the invention relates to the solving of this problem in the case where the two rows of support rollers holding each side support roller are mounted pivotably by means of a support arm, whether this support arm be articulated on a pivot axis on the chocks of the intermediate roll as taught by the document WO 2015/011373, or on the Maes block able to support the chock of the intermediate roll, installed on the Maes block, as taught by the document WO 2011/107165.

FIGS. 1 to 4 illustrate the standard configurations of a laterally supported sexto rolling mill, of the type with cassette, for example taught according to the document WO 2015/011373 or U.S. Pat. No. 6,041,636, in which the support roll transmitting the rolling force to the working roll WR is an intermediate roll IR. This working roll is held laterally by the two rolls of a pair of side support rollers SSR, disposed on either side of the clamping plane of the cage.

Each side support roller SSR is itself held by two rows of support rollers G belonging to a bearing support, fixed to one of the ends of an arm Bs, the other end being articulated about a shaft fixed at the ends thereof to the two chocks of the intermediate roll.

FIG. 1 depicts such a configuration when the intermediate roll and the working roll are new, namely with maximum diameters, for example 355 mm for the intermediate roll and 140 mm for the working roll according to this example. FIG. 4 depicts this configuration when the intermediate roll and the working roll are worn and to be changed, namely with minimum diameters, for example 330 mm for the intermediate roll and 120 mm for the working roll.

At the time of design, the position of the articulation axis between the support arm and the two chocks of the intermediate roll is chosen so that, when the diameter of the working roll WR and the diameter of the intermediate roll IR are at a maximum, there is not any mechanical interference between the side support roller SSR and the intermediate roll IR (see FIG. 1) and so that, when the diameter of the working roll WR and the diameter of the intermediate roll IR at a minimum, there is no interference between the side support roller and the rolled metal strip (see FIG. 4).

It will also be noted from FIG. 1 (or from FIG. 4) that it is possible to cool the working roll by direct spraying, on either side of the clamping plane of the cage of the rolling mill;

- the first jet J1 generated by a first system of nozzles, installed on the bearing support, passes through a passage opening defined by the interspace between the side support roller SSR and the intermediate roll IR, before reaching the working roll, in proximity to the contact between intermediate roll and working roll WR,
- a second jet J2, generated by a second system of nozzles, installed on the bearing support, passes through the interspace between the side support roller SSR and the metal strip, before directly reaching the working roll, or even the metal strip, at the rolling location.

During operation, the surface state of the working roll and the surface state of the intermediate roll deteriorate. Periodically, and as is known, planing of the working roll is carried out, and less frequently planing of the intermediate roll, in order to restore their surface state. These operations involve a reduction in diameter of the planed rolls.

The reduction in diameter of the working roll being thus more rapid than that of the intermediate roll, the inventors observed that the mechanism for supporting and positioning the side support rollers (with a pivot position fixed with respect to the rotation axis of the intermediate roll, and a fixed arm length) has drawbacks for some configurations of diameters of the intermediate roll and of the working roll: thus there are observed risks of interferences between the intermediate roll and the side support roller (or the bearing support thereof), or a risk of obstruction of the passage opening for the jets spraying and lubricating the contact between intermediate roll and working roll, or the jets for lubricating the rolling area.

Thus, and in FIG. 3, depicting a configuration for which the diameter of the intermediate roll is maximum (355 mm) and the diameter of the working roll is minimum (120 mm), it is observed that the spraying jets are interrupted (on the right), the passage opening between the side support roller (right) and the intermediate roll no longer having the jet J1 passing through them, the cooling of the working roll and the interface between intermediate roll and working roll being compromised. A very small jet of 0.7 mm is also observed between the bearing support (on the right) and the intermediate roll, with a risk of mechanical contact.

Likewise, in FIG. 4, for which the diameters of an intermediate roll at the minimum diameter and a working roll at the maximum diameter, it is observed that the distance between the metal strip and each bearing support (left) is small, with only 7.3 mm, representing a significant risk of contact.

SUMMARY OF THE INVENTION

The aim of the present invention is to overcome the aforementioned drawbacks by proposing a rolling method adapted to a mill for rolling a strip making it possible to avoid the aforementioned mechanical interferences between the metal strip and the assembly consisting of side support roller and bearing support, or the mechanical interferences between the assembly consisting of side support roller and bearing support and the intermediate roll, when said bearing support is mounted pivotably on an articulation axis, parallel to the support roll, whether the bearing support be articulated on a pivot axis at the chocks of the intermediate roll as taught for example by the document WO 2015/011373, or on the Maes block able to support the chock of the intermediate roll as taught by the document WO 2011/107165.

More particularly the aim of the present invention is to propose such a method for avoiding the aforementioned interferences throughout the operation of the rolling mill, and whatever the possible configurations of the diameters of the working roll and of the intermediate roll that are caused respectively to reduce the diameter, from a maximum diameter to a minimum diameter.

Another aim of the invention is to propose, at least according to one embodiment, such a method that provides optimum cooling of the contact between intermediate roll and working roll and/or of the rolling area between the working roll and the strip, throughout the operation of the rolling mill, and whatever the possible configurations of the diameters of the working roll and of the intermediate roll.

Another aim of the present invention is to propose a rolling mill as such, suitable for implementing the method.

Other aims and advantages will emerge during the aforementioned description, which is given only by way of indication and which does not aim to limit it.

Thus the invention relates first of all to a rolling method adapted to a mill for rolling a strip, comprising:

- a rolling, by a pair of working rolls with parallel axes, of said strip taken between said working rolls and travelling between the pair of working rolls, each of said working rolls having at least one generatrix of contact with the strip,
- a transmission to said working rolls of a rolling force substantially normal to the strip, by a pair of support rolls, said working rolls and said support rolls situated on the same side of the strip being in contact with each other along a common support generatrix in order to transmit said rolling force,
- a plane perpendicular to a direction of travel of the strip, in which at least one contact generatrix and the axes of said working rolls are situated,
- holding of each of said working rolls by a pair of side support rollers, situated on either side of said perpendicular plane, each of the side support rollers being able to exert, along a bearing generatrix of said working roll, a force holding the axis of the working roll in a given position with respect to a rolling cage of the mill and with respect to said side support rollers,
- support of each of said side support rollers by means of two rows formed by a plurality of rollers mounted side by side, for holding the side support rollers in a given position with respect to the rolling cage of the mill and with respect to said two rows of rollers,
- a support of each of the two rows formed by said plurality of rollers, by means of a bearing support carrying the two rows of rollers, said bearing support being mounted pivotably on an articulation axis, parallel to the support roll, carried by an axis support, such as the chocks of the support roll, or the Maes blocks intended for cambering the support roll, said axis support being fixed with respect to the axis of the support roll.

and in which method the dimensions of a first interspace defined between the side support roller and the support roll and a second interspace defined between the strip and the assembly consisting of side support roller and bearing support vary during rolling because of the reductions in diameters of the support roll and working roll caused by wear and planing of the rolls.

According to the invention, said method comprises a readjustment step for which the dimension of said first interspace and of the second interspace is adjusted by carrying out an adjustment of the dimension separating the axis of said support roll and the axis of said side support roller defining, with the support roll, said first interspace.

According to optional features of the invention, taken alone or in combination:

- said readjustment step consists of adjusting the dimension separating the axis of said support roll and the axis of said side support roller so that the dimension of the first interspace is at least equal to a lower limit $\Delta min1$ and the dimension of the second space is at least equal to a lower limit $\Delta min2$, said lower limit $\Delta min1$ and the lower limit $\Delta min2$ being for example greater than or equal to 5 mm;
- the diameter of the support roll lying between a maximum diameter and a minimum diameter, a method wherein a nominal diameter is defined, smaller than the maximum diameter and larger than the minimum diameter, and wherein:
  - a first rolling configuration is maintained without a readjustment step so long as the diameter of the support roll lies between the maximum diameter and the nominal diameter,
  - a second rolling configuration is obtained, when the support roll is at the nominal diameter, by performing said readjustment step with reduction of the dimension separating the axis of said support roll and the axis of said side support roller SSR,
  - said second configuration obtained by said readjustment step is maintained as long as the diameter of the support roll lies between the nominal diameter and the minimum diameter;
- the rolling mill has at least spray nozzles affording cooling by spraying of at least one jet of fluid onto at least part of the strip and at least part of one of said rolls and wherein a cooling step is implemented comprising at least one direct spraying of at least part of the working rolls, on either side of said plane perpendicular to the direction of travel of the strip, said nozzles being configured to:
  - produce a jet directed towards the working roll, from at least one side of the plane perpendicular to the direction of travel, the jet passing through said first interspace between the side support roller and the support roll, before reaching said working roll, and/or
  - producing a jet directed towards the working roll, from at least one side of the plane perpendicular to the direction of travel, passing through the interspace between the strip and the side support roller, before reaching said working roll and/or said strip;

said bearing support is fixedly mounted removably on an arm, with an adjustable position on the arm, said arm itself being articulated on said articulation axis, parallel to said support roll, providing the pivoting of said bearing support about said articulation axis, and wherein said adjustment of the dimension separating the axis of said support roll and the axis of said side support roller implemented during the readjustment step is performed by a step of modifying the position of said bearing support on the arm;

the mill comprises a removable means of fixing between said bearing support and said arm comprising a groove/key positive-location system, said key and the groove carried respectively by said bearing support and said arm, or vice versa, said key or the groove carried by the bearing support being offset in the longitudinal direction of the arm, with respect to the plane, parallel to the backup-roll axis, passing through the median line to the segment, perpendicular to the side support roller, joining the two axes of the two rows of rollers, and in said adjustment of the dimensions separating the axis of said support roll and the axis of said side support roller implemented during the readjustment step is performed by a step of turning over said bearing support on the arm;

said bearing support being mounted fixed on an arm itself articulated on said articulation axis parallel to said support roll providing the pivoting of said bearing support about said articulation axis, and wherein said adjustment of the dimension separating the axis of said support roll and the axis of said side support roller implemented during the readjustment step is performed by a step of adjusting the position of said articulation axis with respect to the support arm: for example an eccentric is provided between the articulation axis and said arm, and wherein said adjustment of the dimension separating the axis of said support roll and the axis of said side support roller implemented during the readjustment step is performed by a step of rotation of said eccentric;

said articulation axis, around which the bearing support is mounted, is supported and mounted on said axis support and wherein said adjustment of the dimension separating the axis of said support roll and the axis of said side support roller implemented during the readjustment step is performed by a step of modifying the position of said articulation axis on said axis support: for example, said step of modifying the position of said articulation axis on said axis support is obtained by adding or removing shims between the axis support and said articulation axis, or alternatively said step of modifying the position of said articulation axis on said axis support is obtained by rotating an eccentric provided between said articulation axis and said axis support;

said support roll is supported at the ends thereof by chocks, and wherein said adjustment of the dimension separating the axis of said support roll and the axis of said lateral bearing roll implemented during the readjustment step is performed by a step of modifying the position of the axis of said support roll with respect to the Maes blocks intended for cambering the support roll;

said readjustment step is implemented when rolling is interrupted, after planing of the working roll and/or of the support roll.

The invention also relates to a mill for rolling a strip including at least one cage, comprising:

a pair of working rolls with parallel axes, between which the strip passes, each of said working rolls having at least one generatrix of contact with the strip, a plane perpendicular to a direction of travel of the strip, wherein at least one contact generatrix and the axes of said working rolls are situated, a pair of support rolls, with axes parallel to the plane of the strip and situated on either side of said strip, said support rolls and working rolls situated on the same side of the strip being in contact with each other along a common support generatrix in order to transmit to the working rolls, a rolling force substantially normal to the strip, two pairs of side support rollers with parallel axes, said rolls in the same pair being situated symmetrically on either side of one of said working rolls, in a plane parallel to the strip, so that each of the side support rollers in the same pair is able to transmit, along a bearing generatrix of said working roll, a force affording holding in a given position in relation to the support roll, a support for each of said support rollers by means of two rows formed by a plurality of support rollers mounted side by side, for holding the side support rollers in a given position, support of each of the two rows formed by said plurality of support rollers, by means of a bearing support carrying the two rows, said bearing support being mounted pivotally on an articulation axis, parallel to the support roll, carried by an axis support, fixed with respect to the axis of the support roll, such as the chocks of the support roll, or the Maes blocks intended for cambering the support roll, wherein the mill comprises, during the rolling of the metal strip, a first interspace defined between the side support roller and the support roll and a second interspace defined between the strip and the assembly consisting of side support roller and bearing support liable to vary during rolling because of the reductions in diameters of the support roll and of the working roll caused by wear or planing of the rolls.

According to the invention, said mill comprises an adjustment device configured to adjust the dimension of said first interspace and the dimension of the second interspace using an adjustment of the dimension separating the axis of said support roll and the axis of said side support roller defining, with the support roll, said first interspace.

According to optional features of the invention taken alone or in combination:

the mill comprises a device configured for cooling by spraying at least one jet of fluid on at least part of the strip and at least part of one of said rolls, comprising at least one system of nozzles with nozzles configured to:

produce a jet directed towards the working roll, from at least one side of the plane perpendicular to the direction of travel, the jet passing through a first interspace between the side support roller and the support roll, before reaching said working roll, and/or produce a jet directed towards the working roll, from at least one side of the plane perpendicular to the direction of travel, passing through the interspace between the side support roller and the strip, before reaching said working roll and/or the strip;

the adjustment device comprises said bearing support that is fixedly mounted removably on an arm, with a position adjustable on the arm, said arm being itself articulated on said articulation axis parallel to the support roll providing the pivoting of said bearing support about said articulation axis, and wherein the adjustment device is configured so that the adjustment of the dimension separating the axis of said support roll and the axis of said side support roller is performed by modifying the position of said bearing support on the arm: for example the adjustment device comprises a removable means of fixing between said bearing support and said arm comprising a groove/key positive-location system, said key and the groove carried respectively by said bearing support and said arm, or vice versa, said key or the groove carried by the bearing support being offset in the longitudinal direction of the arm, with respect to the plane, parallel to the side support roller, passing through the median line to the segment perpendicular to the side support roller joining the two axes of two rows of rollers, and wherein the adjustment device is configured so that said adjustment of the dimension separating the axis of said support roll and the axis of said side support roller is performed by turning over said bearing support;

said bearing support being mounted fixedly on an arm itself articulated on said articulation axis parallel to said support roll providing the pivoting of said bearing support about said articulation axis, and wherein the adjustment device is configured so that the adjustment of the dimension separating the axis of said support roll and the axis of said side support roller implemented during the readjustment step is performed by adjusting the position of said articulation axis on the arm; for example, said adjustment device comprises an eccentric provided between the articulation axis and said arm, and wherein the adjustment device is configured so that said adjustment of the dimension separating the axis of said support roll and the axis of said side support roller is performed by a step of rotating said eccentric;

said articulation axis around which the bearing support is mounted is supported and mounted on an axis support and wherein the adjustment device is configured so that the adjustment of the dimension separating the axis of said support roll and the axis of said side support roller is performed by modifying the position of said articulation axis on said axis support; for example, the adjustment device comprises shims, said adjustment device configured so that the modification of the position of said articulation axis on said axis support is obtained by adding or removing shims between the axis support and said articulation axis, or alternatively said adjustment device comprises an eccentric provided between said articulation axis and said axis support and wherein said adjustment device is configured so that the modification of the position of said articulation axis on said axis support is obtained by rotating the eccentric.

BRIEF DESCRIPTION OF THE DRAWINGS

The invention will be understood better from a reading of the description accompanied by the appended figures, depicting the invention, among which.

Figure 5:
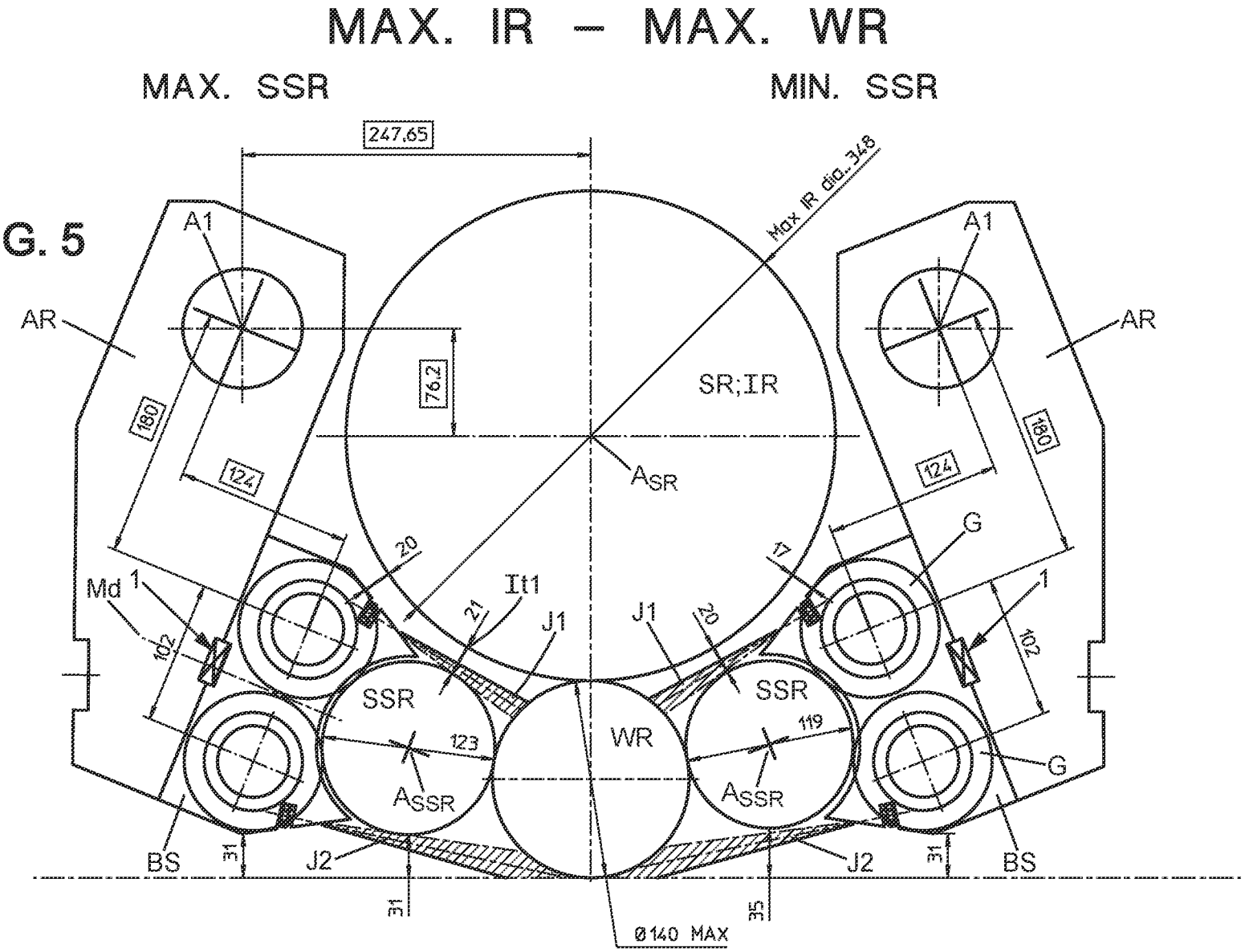
FIGS. 5 to 10 illustrate a first embodiment of the invention for which the readjustment step is obtained by turning over the bearing supports fixed to the arms, the figures illustrating the rolling-mill cage according to various configurations of diameters of the working roll and diameters of the intermediate roll, as well as according to various configurations of the position of the assembly consisting of bearing support and side support roller on the arm, namely respectively.
Figure 6A:
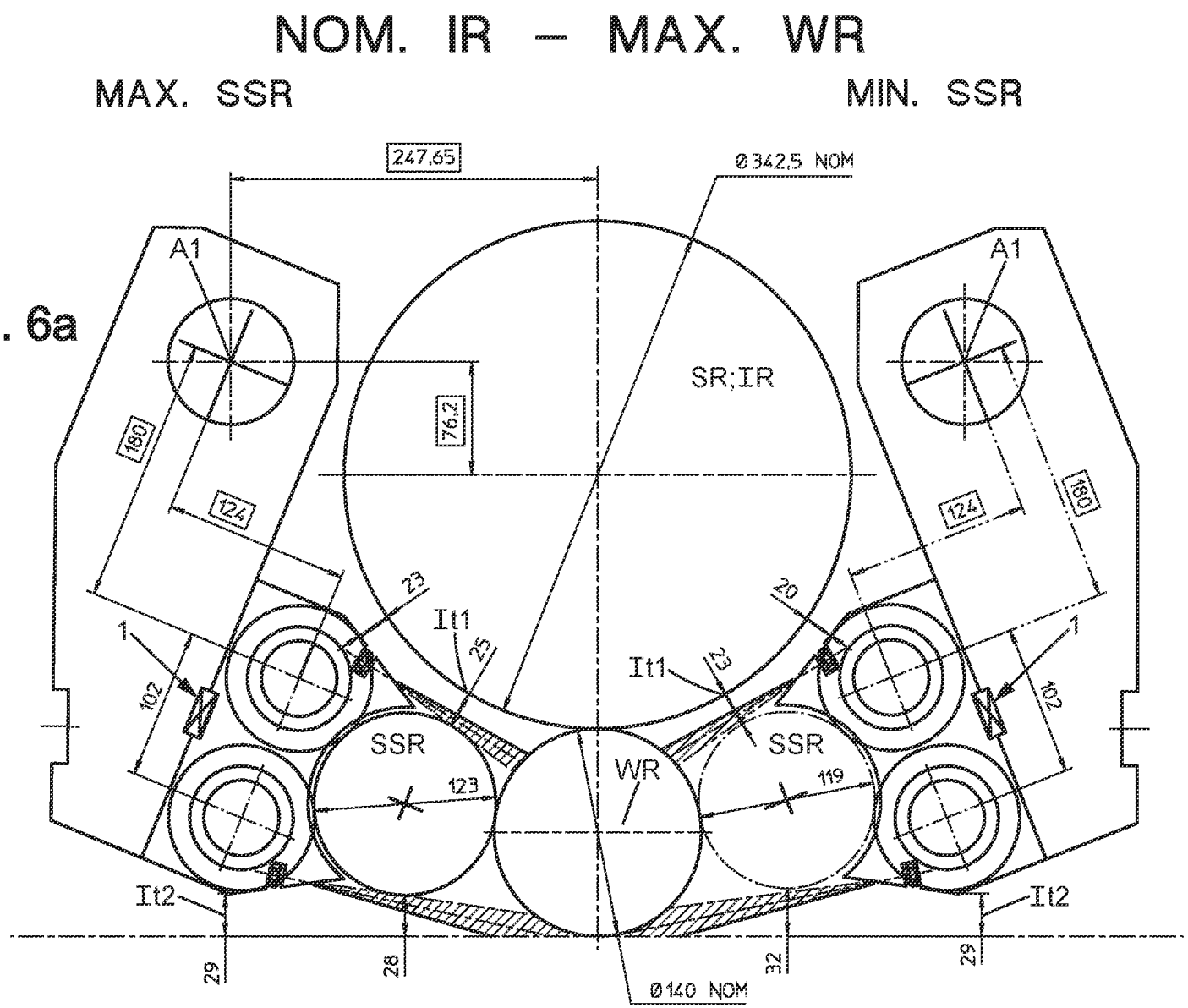
Figure 6B:
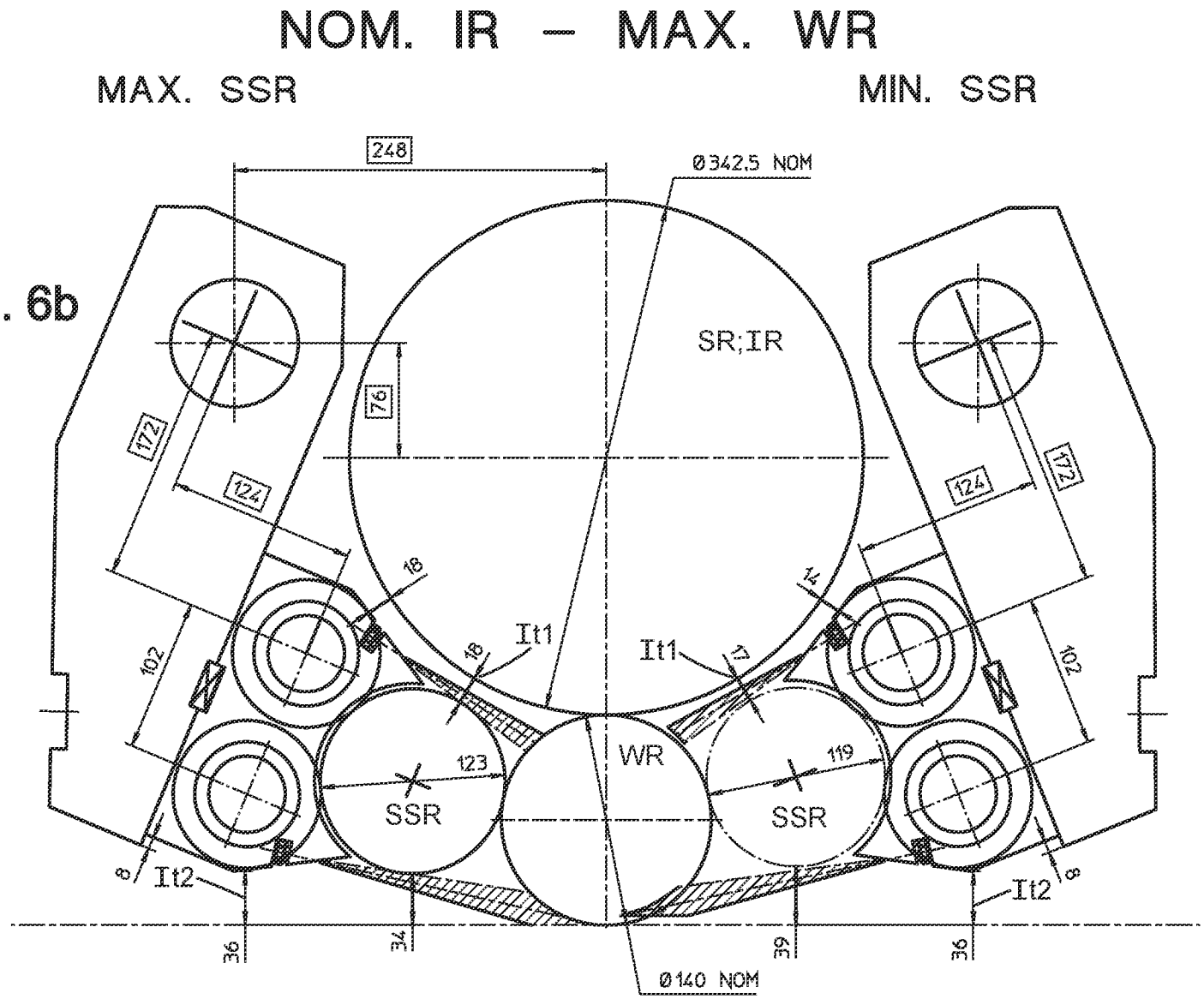
Figure 7:
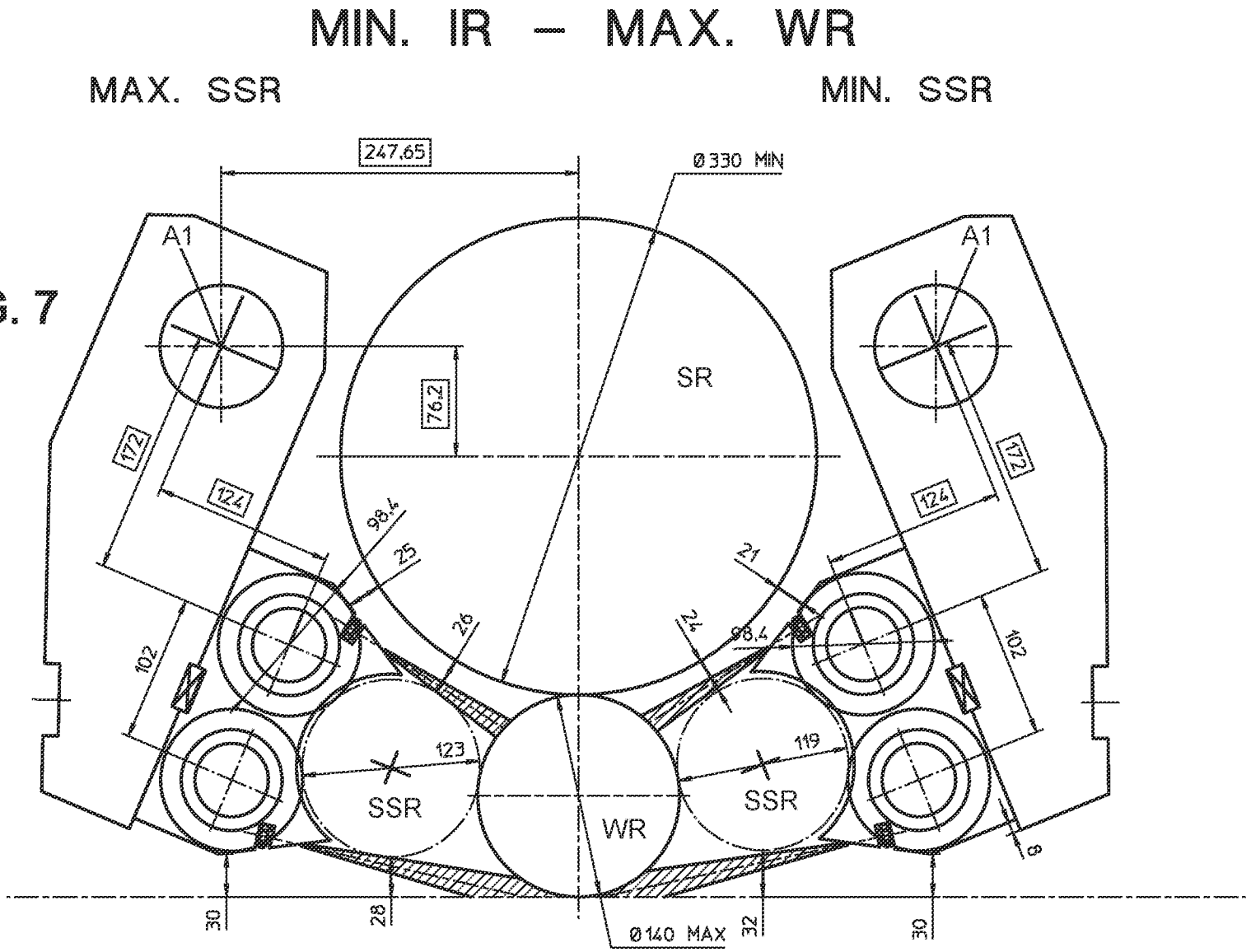
Figure 8:
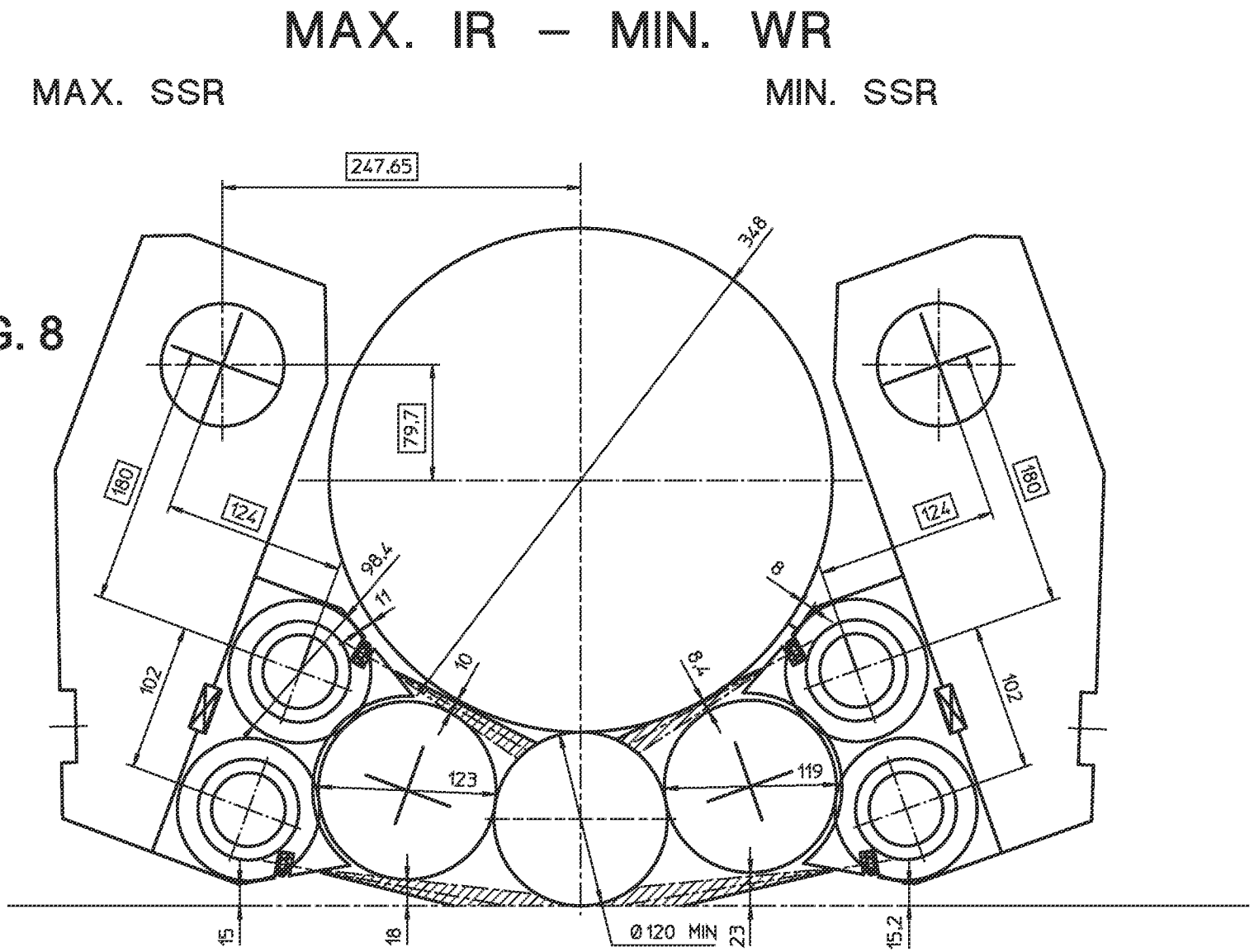
Figure 9A:
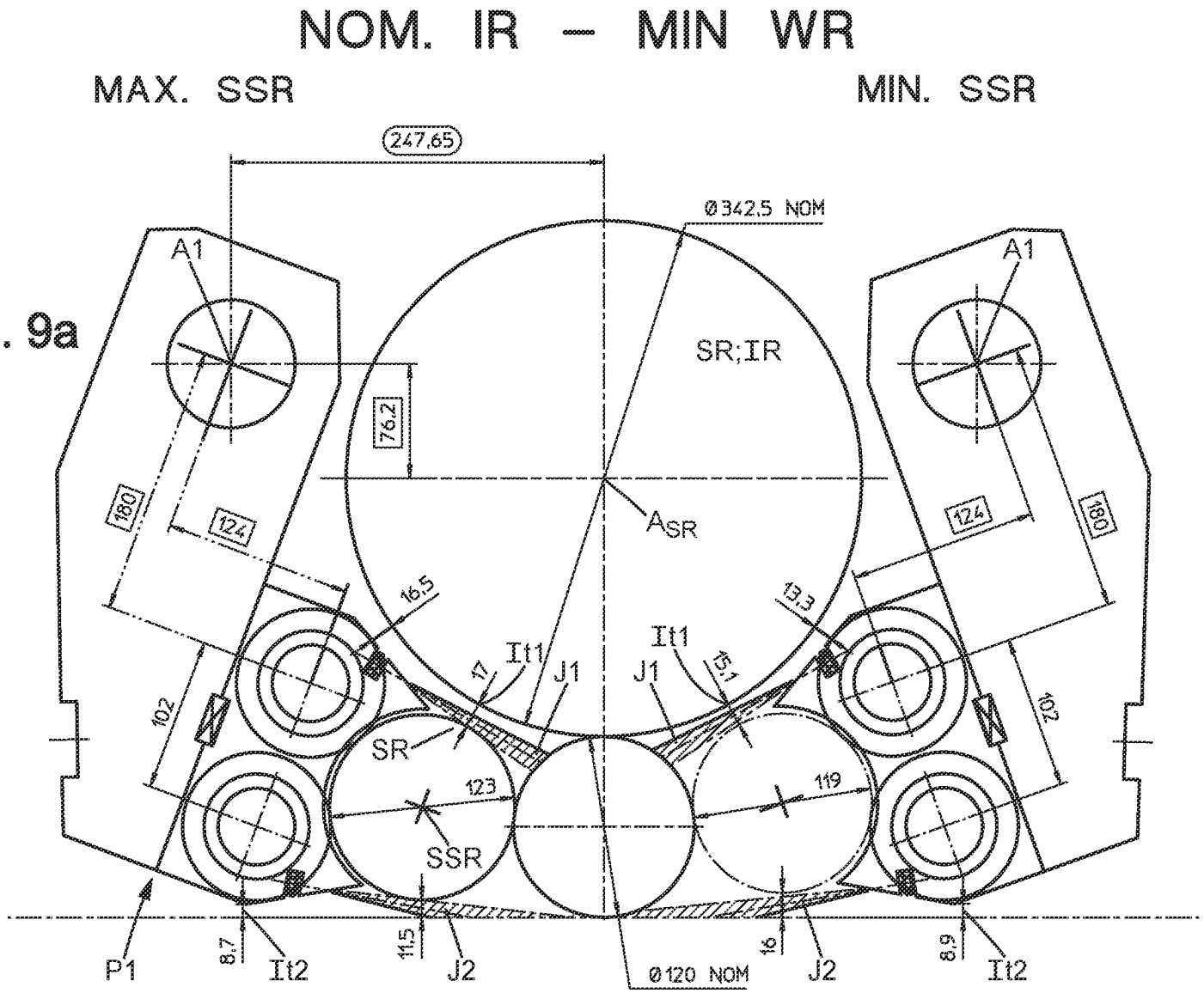
Figure 9B:
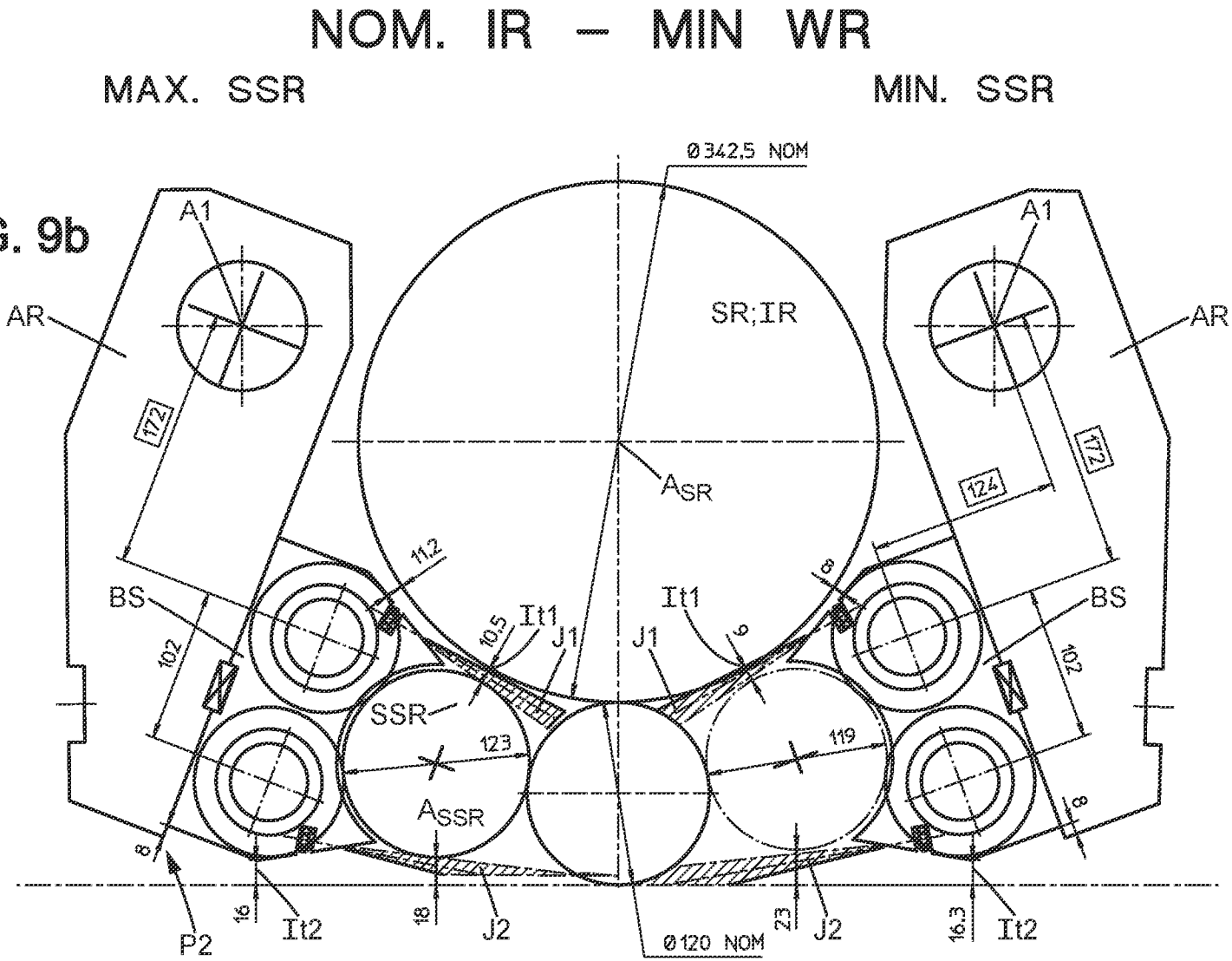
Figure 10:
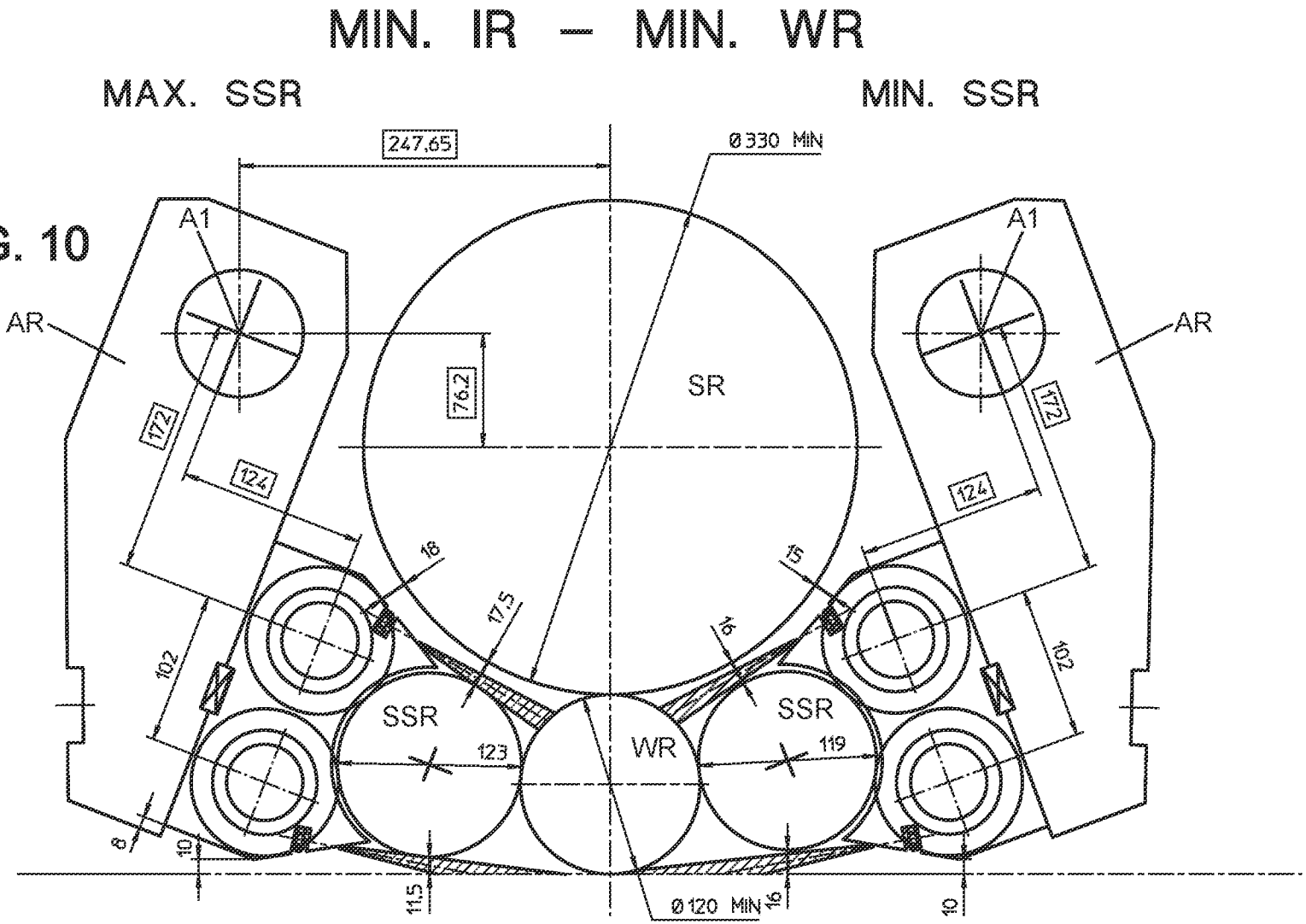
Figure 11:
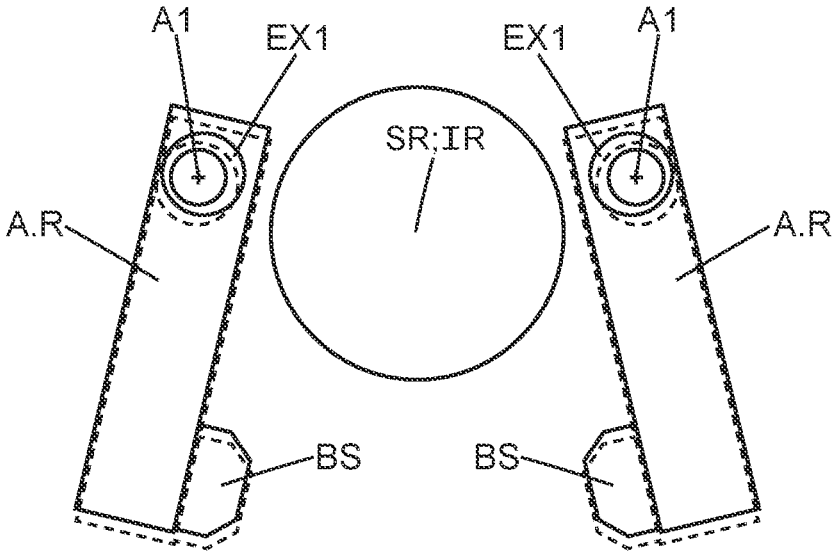
Figure 12:
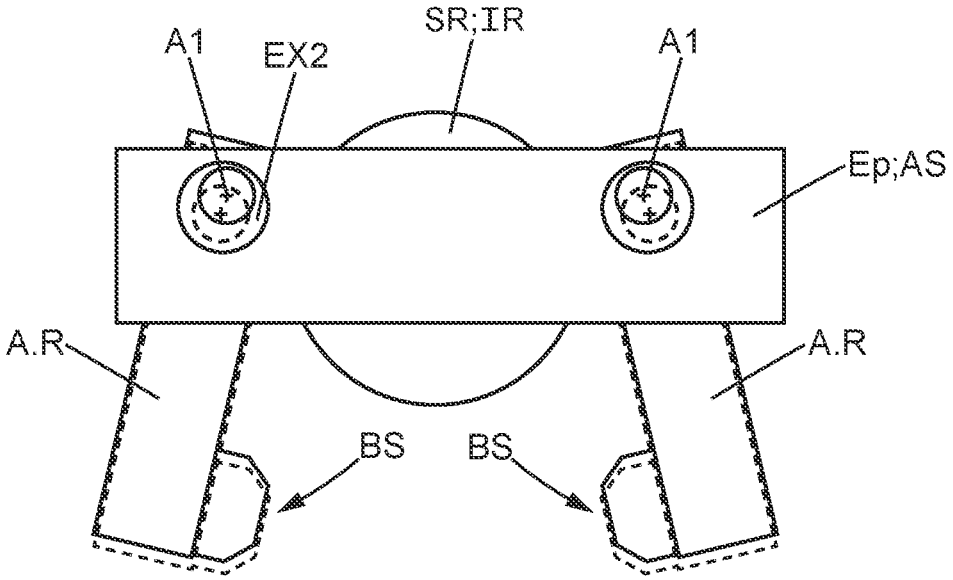
Figure 13:
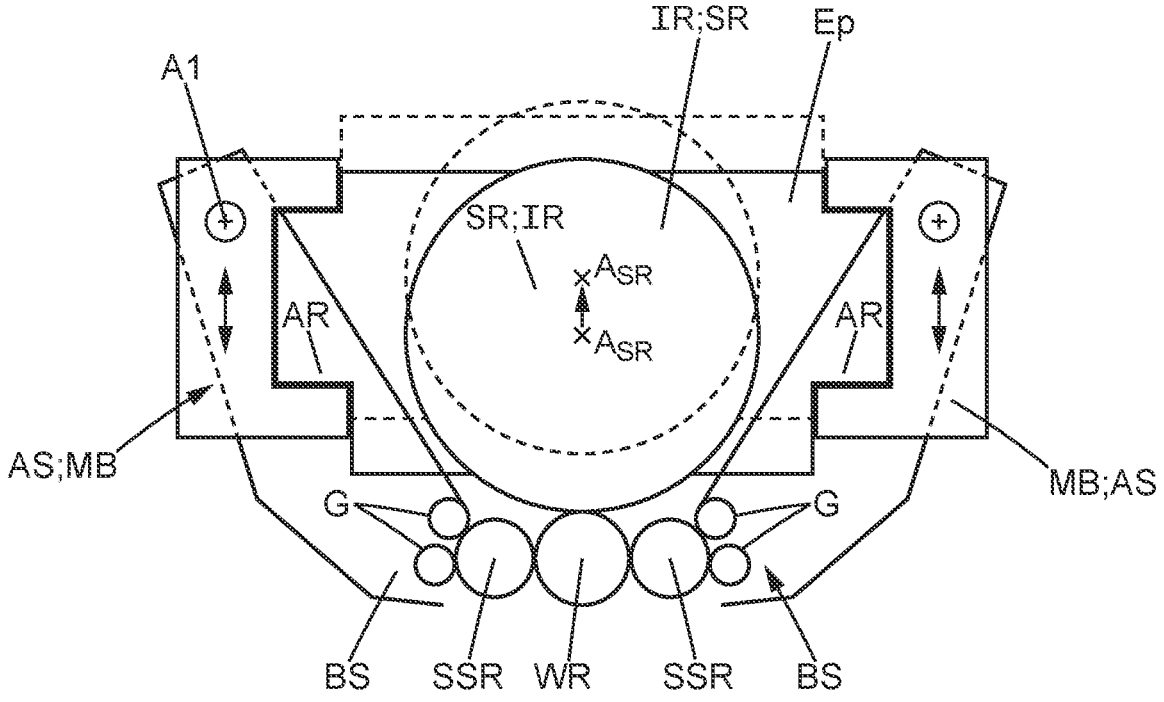

a configuration illustrated in FIG. 5 for which the working roll and the intermediate roll have maximum diameters (348 mm maximum diameter for the intermediate roll and 140 mm maximum diameter for the working roll), and according to a first position of the bearing support on the arm for which the axis of the rollers in the first row is at a distance of 180 mm from the pivot axis of the arm;

two configurations illustrated respectively in FIGS. 6*a* and 6*b*, for which the working roll is at its maximum diameter and the intermediate roll at its nominal diameter (342.5 mm nominal diameter for the intermediate roll and 140 mm maximum diameter for the working roll), FIG. 6*a* illustrating the configuration according to the first position of the bearing support on the arm for which the axis of the rollers of the first row is at a distance of 180 mm from the pivot axis of the arm, FIG. 6*b* illustrating another configuration, after turning over of the bearing support on the arm, and according to a second position of the bearing support on the arm for which the axis of the rollers of the first row is at a distance of 172 mm from the axis of the pivot arm, a configuration illustrated in FIG. 7 for which the working roll is at its minimum diameter and the intermediate roll at its maximum diameter (348 mm maximum diameter for the intermediate roll and 120 mm minimum diameter for the working roll) and according to the first position of the bearing support on the arm for which the axis of the rollers in the first row is at a distance of 180 mm from the pivot axis of the arm, a configuration illustrated in FIG. 8 for which the working roll is at its minimum diameter and the intermediate roll at its maximum diameter (348 mm maximum diameter for the intermediate roll and 120 mm minimum diameter for the working roll) and according to the first position of the bearing support on the arm for which the axis of the rollers in the first row is at a distance of 180 mm from the pivot axis of the arm, two configurations illustrated respectively in FIGS. 9*a* and 9*b* for which the working roll is at its minimum diameter and the intermediate roll at its nominal diameter (342.5 mm nominal diameter for the intermediate roll and 120 mm minimum diameter for the working roll), FIG. 9*a* illustrating the configuration according to the first position of the bearing support on the arm for which the axis of the rollers in the first row is at a distance of 180 mm from the pivot axis of the arm, FIG. 9*b* illustrating another configuration according to a second position of the bearing support on the arm for which the axis of the rollers in the first row is at a distance of 172 mm from the pivot axis of the arm, FIG. 10 is a view of a configuration for which the working roll is at its minimum diameter and the intermediate roll at its minimum diameter (330 mm maximum diameter for the intermediate roll and 120 mm minimum diameter for the working roll) and according to the second position of the bearing support on the arm for which the axis of the rollers in the first row is at 172 mm from the pivot axis of the arm, FIG. 11 is a view illustrating a second embodiment of the invention for which an eccentric is provided between the articulation axis and said arm, and in which said adjustment of the dimension separating the axis of said support roll and the axis of said side support roller used during the readjustment step is carried out by a step of rotation of said eccentric, FIG. 12 is a view illustrating a third embodiment of the invention for which said adjustment of the dimension separating the axis of said support roll and the axis of said side support roller implemented during the readjustment step is performed by a step of modifying the position of said articulation axis on said axis support formed here by the chocks of the support roll, said step of modifying the position of said articulation axis on the chocks being obtained by rotating an eccentric provided between said articulation axis and the chocks, FIG. 13 is a schematic view of a fourth embodiment for which the assembly consisting of side support roller and bearing support is articulated via an arm on the Maes block intended for cambering the support roll, the assembly consisting of side support roller and bearing support being able to be moved in accordance with the movement of the Maes block and in which said adjustment of the dimension separating the axis of said support roll and the axis of said side support roller implemented during the readjustment step is performed by a step of modifying the position of said support roll with respect to the Maes block intended for cambering the support roll, carried out for example by turning the asymmetric chocks of the support roll through 180°.

DESCRIPTION OF THE PREFERRED EMBODIMENTS

Thus the invention relates to a rolling method adapted to a strip rolling mill comprising the following steps:

- a rolling, by a pair of working rollers WR with parallel axes, of said strip taken between said working rolls WR and travelling between the pair of working rolls, each of said working rolls having at least one generatrix of contact with the strip,
- a transmission, to said working rolls WR, of a rolling force substantially normal to the strip, by a pair of support rolls SR, said working rolls WR and said support rolls SR situated on the same side of the strip being in contact with each other along a common support generatrix in order to transmit said rolling force,
- a plane perpendicular to a direction of travel of the strip, in which at least one contact generatrix and the axes of said working rolls are situated,
- holding of each of said working rolls WR by a pair of side support rollers SSR, situated on either side of said perpendicular plane, each of the side support rollers SSR being able to exert, along a bearing generatrix of said working roll WR, a force maintaining the axis of the working roll WR in a given position with respect to a rolling cage of the mill and with respect to said side support rollers,
- support of each of said side support rollers by means of two rows formed by a plurality of rollers G mounted side by side, for maintaining the side support rollers SSR in a given position,
- support of each of the two rows formed by said plurality of rollers G, by means of a bearing support BS carrying the two rows, said bearing support being mounted pivotally on an articulation axis A1, parallel to the support roll SR, carried by an axis support AS, such as the chocks Ep of the support roll, or the Maes blocks MB intended for cambering the support roll, said axis support AS being fixed with respect to the axis of the support roll SR.

The rolling mill may be a rolling cage comprising the two working rolls, the two support rollers and the two support rolls, each support roll being intermediate between said bearing roller and said working roll, namely a rolling-mill cage of the laterally supported sexto type.

Figure 1:
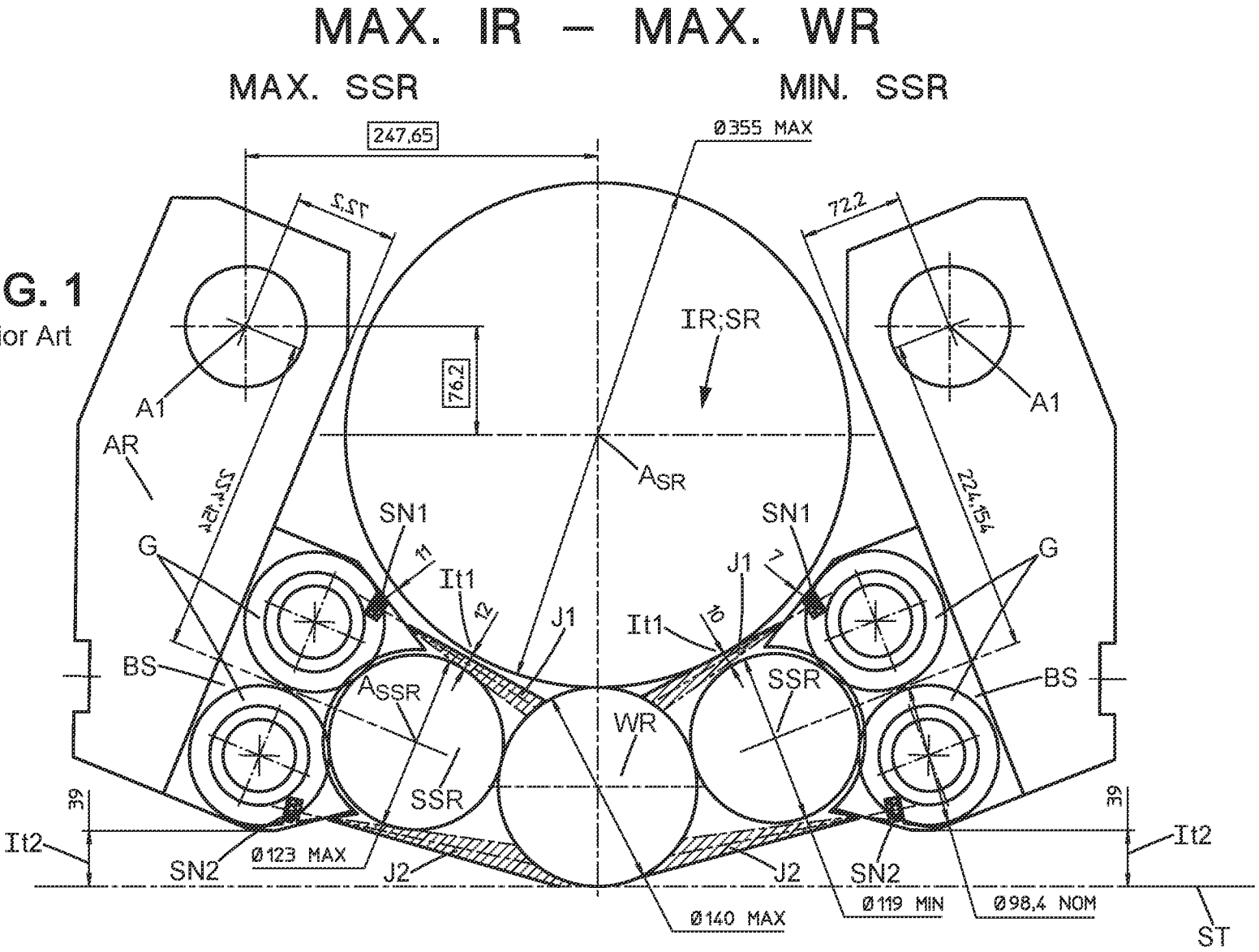
FIG. 1 Prior Art
Figure 2:
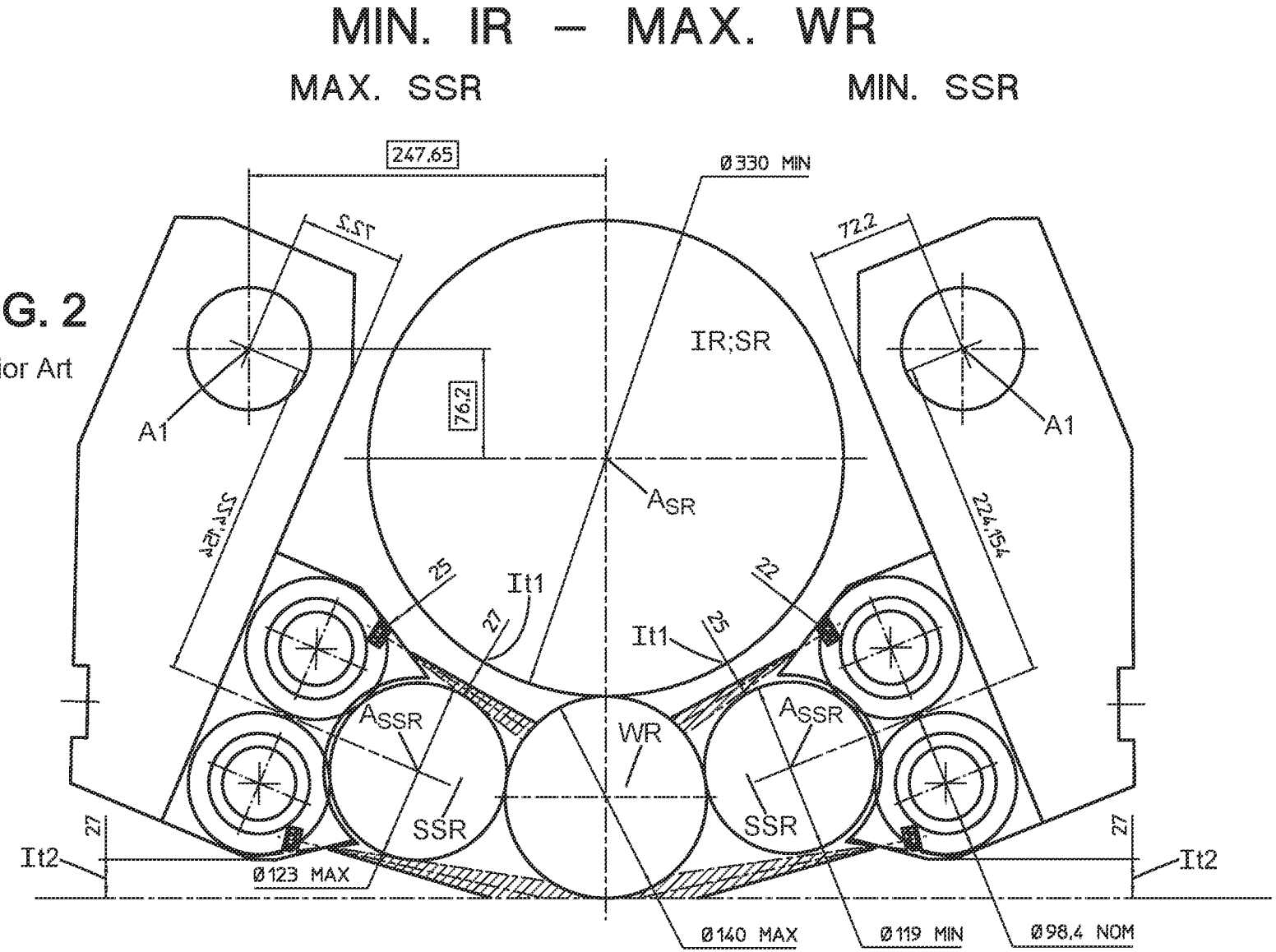
FIG. 2 Prior Art

According to a possibility illustrated in accordance with FIGS. 1 and 12, said articulation axis A1 about which the bearing support BS is mounted is supported and mounted secured to two chocks Ep of the support roll SR (in other words the intermediate roll IR), the assembly consisting of intermediate roll IR, bearing supports BS and two of the side support rollers SSR, on either side of the perpendicular plane forming a self-supporting assembly able to be introduced into or removed from the cage by sliding the assembly in the direction of the rolls, typically referred to as a "cassette" or "insert", and as known per se from the document WO 2015/011373.

According to another possibility illustrated in FIG. 13, said articulation axis A1, about which the bearing support BS is pivotally mounted, is supported and mounted installed on a Maes block MB intended for cambering the intermediate roll IR, able to be moved vertically along the uprights of the cage and as known per se from the document WO 2011/107165.

When the rolling method is implemented, the dimensions of a first interspace It1 defined between the side support roller SSR and the support roll SR and of a second interspace It2 defined between the strip ST and the assembly consisting of side support roller SSR and bearing support BS vary during rolling because of the reductions in diameters of the support roll and of the working roll.

The reductions in diameter are caused by wear and planing of the rolls. Periodically, and in a known manner, the working rolls and the support rolls are removed from the cage: planing of the working roll is carried out, and less frequently planing of the intermediate roll, in order to restore the surface state thereof.

The inventors observe that the mechanism supporting and positioning the side support rollers with a pivot position fixed with respect to the axis of rotation of the intermediate roll, and a fixed arm length (as in particular taught by the document WO 2011/107165 or WO 2015/011373) have drawbacks for some configurations of diameters of the intermediate roll and of the working roll: thus risks of interferences between the intermediate roll and the side support roller are observed, or a risk of obstruction of the passage opening for the jets spraying and lubricating the contact between intermediate roll and working roll, or obstruction of the jets for lubricating the rolling area.

Figure 3:
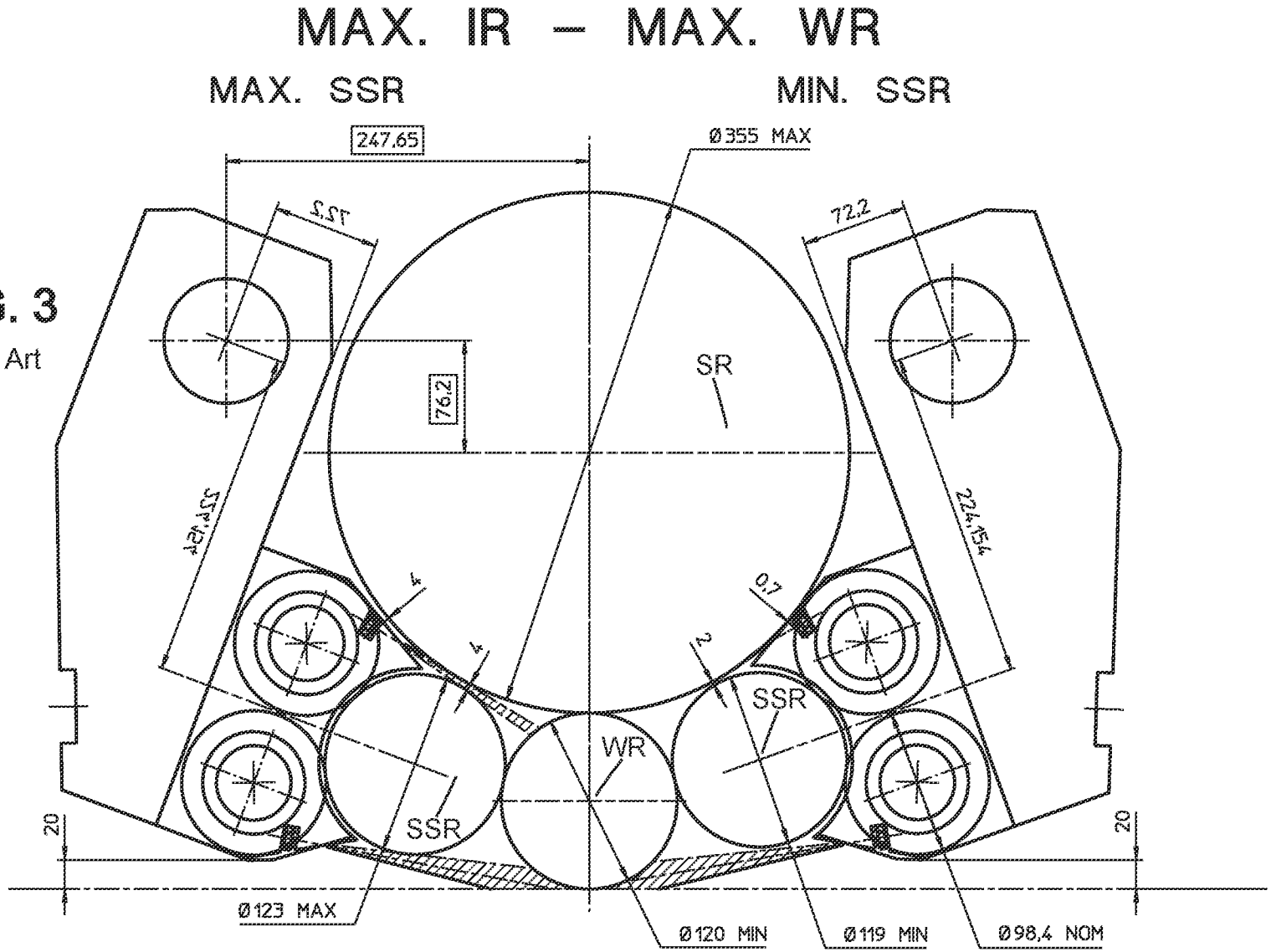
FIG. 3 Prior Art

Thus, and in FIG. 3 depicting such a prior art and according to a configuration for which the diameter of the intermediate roll is maximum (355 mm) and the diameter of the working roll is minimum (120 mm), it is observed that the spraying jets are interrupted (on the right), the passage opening between the side support roller (right) and intermediate roll is so small that the jet J1 no longer passes through it, the cooling of the working roll and of the interface between intermediate roll and working roll being compromised. A very small clearance of 0.7 mm between the bearing support (on the right) and the intermediate roll is also observed, with risk of mechanical contact.

Figure 4:
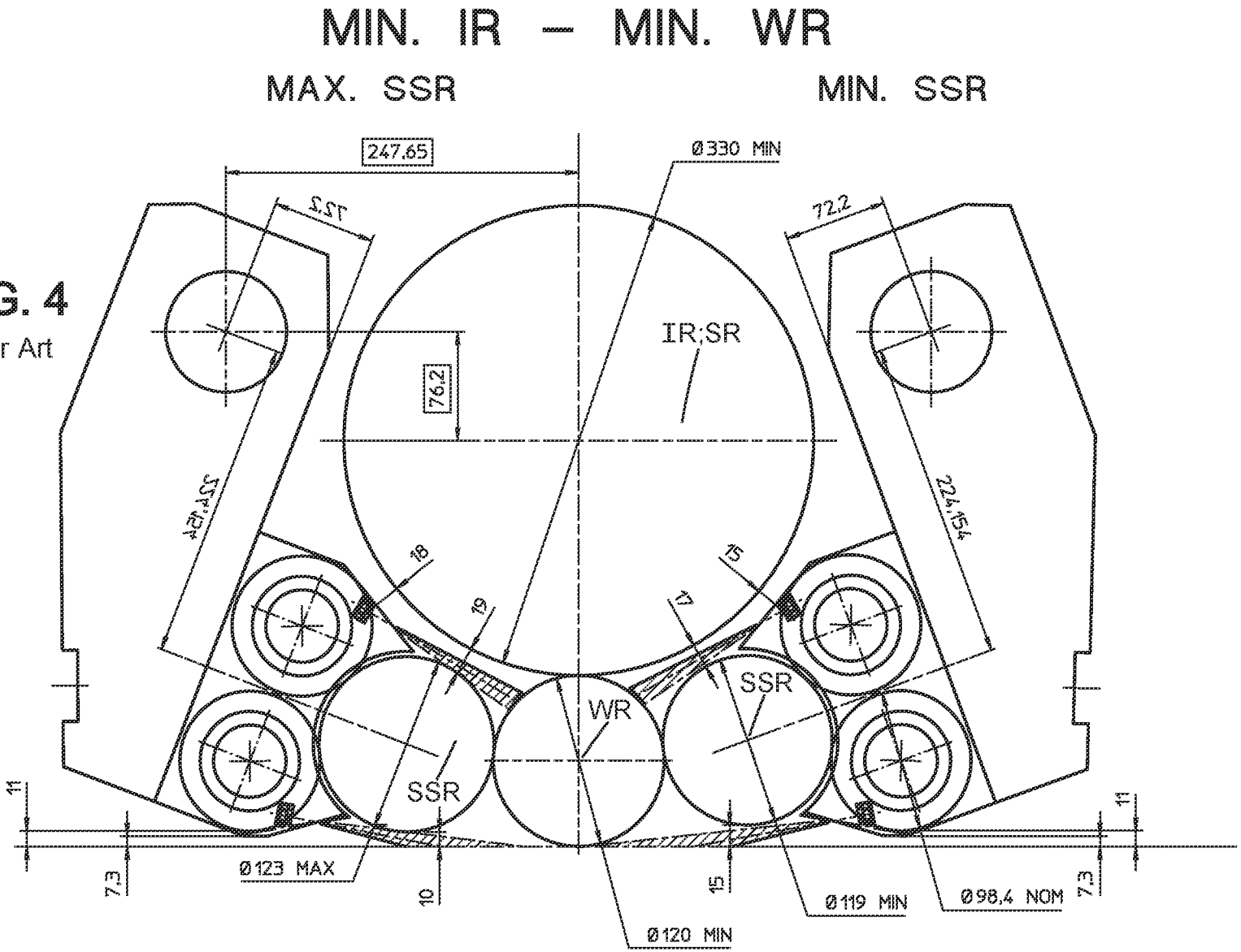
FIG. 4 Prior Art

Likewise in FIG. 4, for which the diameters of an intermediate roll at the minimum diameter and a working roll at the maximum diameter, it is observed that the distance between the metal strip and each bearing support (left) is small, with only 7.3 mm, representing a significant risk of contact.

The invention advantageously makes it possible to avoid such mechanical interferences by using a readjustment step for which the dimension of said first interspace It1 and of the second interspace It2 is adjusted by implementing an adjustment of the dimension separating the axis $A_{SR}$ of said support roll SR and the axis $A_{SSR}$ of said side support roller SSR defining, with the support roll, said first interspace It1.

This readjustment step can advantageously be implemented when there is an interruption of the rolling, for example simultaneously with an interruption of rolling for planing of the working roll and/or of the support roll.

This readjustment step consists in adjusting the dimension separating the axis of said support roll SR and the axis of said side support roller SSR so that the dimension of the first interspace It1 is at least equal to a lower limit Δmin1 and the dimension of the second space It2 is at least equal to a lower limit Δmin2, whatever the configurations, namely as long as:

- the diameter of the working roll WR is between a minimum diameter and a maximum diameter,
- the diameter of the support roll SR is between a minimum diameter and a maximum diameter.

This lower limit Δmin1 and this lower limit Δmin2, which may be equal or distinct, may be greater than or equal to 5 mm.

FIGS. 5 to 10 illustrate the various possible configurations of a rolling-mill cage of the laterally supported sexto type with cassette, as the prior art shown in FIGS. 1 to 4.

These FIGS. 5 to 10 show the support roll SR, which is the intermediate roll IR, and which transmits the rolling force to the working roll WR. The support roll SR is conventionally articulated at its ends in chocks.

On either side of the clamping plane, each side support roller SSR is held by two rows of rollers G of a bearing support BS mounted pivotally via an arm AR on the articulation axis A1 on an axis support formed by the chocks of the support roll SR. The support roll SR with its chocks, the arms AR, the bearing supports BS and the pair of side support rollers form a self-supporting assembly that can be removed when the cage is opened, in a way known per se from the prior art.

According to this embodiment, said bearing support BS is fixedly mounted removably on an arm AR, with an adjustable position on the arm, said arm AR itself being articulated on said articulation axis A1, parallel to said support roll, providing the pivoting of said bearing support about said articulation axis A1.

Remarkably, and according to this embodiment, said adjustment of the dimension separating the axis of said support roll SR and the axis of said side support roller SSR implemented during the readjustment step is performed by a step of modification of the position of said bearing support BS on the arm AR.

More particularly, provision can be made for a removable fixing means between said bearing support BS and said arm AR comprising a groove/key positive-location system 1, said key and a groove carried respectively by said bearing support BS and said arm AR, or vice versa.

As can be seen in FIG. 5, said key or the groove carried by the bearing support is remarkably offset in the longitudinal direction of the arm AR, with respect to the plane, parallel to the axis of the bearing roller, passing through the median line Md to the segment, perpendicular to the side support roller, joining the two axes of the two rows of rollers G.

The adjustment of the dimension separating the axis of said support roll and the axis of said side support roller implemented during the readjustment step is carried out by a step of turning over said bearing support BS on the arm.

This readjustment step carried out by turning over said bearing support BS on the arm AR is illustrated by way of example in FIGS. 9*a* and 9*b*.

The two configurations illustrated respectively in FIGS. 9*a* and 9*b* are configurations for which the working roll is at its minimum diameter and the intermediate roll at its nominal diameter (342.5 mm nominal diameter for the intermediate roll and 120 mm minimum diameter for the working roll).

FIG. 9*a* illustrates the configuration according to the first position P1 of the bearing support on the arm for which the axis of the rollers in the first row is at a distance of 180 mm from the articulation axis A1 of the arm, whereas FIG. 9*b* illustrates another configuration according to a second position P2 of the bearing support on the arm for which the axis of the rollers in the first row is at a distance of 172 mm from the pivot axis of the arm.

The passage from the first position P1 of the bearing support to the second position P2 of the bearing support is obtained by simple turning of said bearing support BS through 180° on the arm, when rolling is interrupted.

This turning over effects a modification of the dimension separating the axis $A_{SR}$ of said support roll SR and the axis $A_{SSR}$ of said side support roller SSR defining, with the support roll, said first interspace It1, and in this case a reduction in the dimension separating the axis $A_{SR}$ of said support roll SR and the axis $A_{SSR}$ of said side support roller SSR (from FIG. 9*a* to FIG. 9*b*).

A readjustment (a modification) of the dimension of said first interspace It1 and of the second interspace It2 is then observed:

- in FIG. 9*a*, and according to the first position P1 of the bearing support BS on the arm, the first interspace between the side support roller SSR (left) and the support roll (SR) is 17 mm and the first interspace between the side support roller SSR (right) and the support roll SR is 15.1 mm, on the one hand, and the second interspace between the strip and the assembly consisting of bearing support and side support roller (left) is 8.7 mm and the second interspace between the strip and the assembly consisting of bearing support and side support roller (right) is 8.9 mm,
- in FIG. 9*b*, and according to the second configuration P2 of the bearing support BS on the arm, the first interspace between the side support roller SSR (left) and the support roll SR is 10.5 mm, and the first interspace between the side support roller SSR (right) and the support roll SR is 9 mm, on the one hand, and the second interspace between the strip and the assembly consisting of bearing support and side support roller (left) is 18 mm, the second interspace between the strip and the assembly consisting of bearing support and side support roller (right) is 16.3 mm.

It will be noted that, at this nominal diameter of the support roll SR (here in this case equal to 342.5 mm) and whereas the working roll is at minimum diameter (here in this case 120 mm), the most critical case in terms of risks of mechanical interference, it is possible to proceed with the readjustment step, keeping, before (FIG. 9*a*) and after (FIG.

9*b*) the readjustment step, a value of the first interspace It1 and an interspace value It2 sufficient to prevent risks of mechanical interference.

It will be noted that this change to be made by turning over the bearing support when the support roll is at its nominal diameter (342.5 mm) but the working roll is at its maximum diameter (140 mm) does not pose any difficulty in that the first interspace It1 and the second interspace It2 have values that are even more comfortable in terms of risks of mechanical interference, and as can be seen in FIGS. 6*a* and 6*b*.

As can be understood from FIGS. 5 to 10:

- the first rolling configuration (first position P1 of the bearing support on the arm for which the axis of the rollers in the first row is at a distance of 180 mm from the articulation axis A1 of the arm) can be kept without risk of mechanical interference as long as the diameter of the support roll SR is between the maximum diameter and the nominal diameter and whatever the diameter of the working roll lying between the minimum diameter and the maximum diameter, and as can be understood more particularly from FIGS. 6*a* and 9*a*,
- the second rolling configuration (second position P2 of the bearing support on the arm for which the axis of the rollers in the first row is at a distance of 172 mm from the articulation axis A1 of the arm) can be kept without risk of mechanical interference, as long as the diameter of the support roll SR is between the nominal diameter and the minimum diameter and whatever the diameter of the working roll lying between the minimum diameter and the maximum diameter, and as can be understood more particularly from FIGS. 6*b* and 9*b*.

The problems of mechanical interferences and obstruction of jets identified in FIGS. 3 and 4 representing the prior art are solved:

- a comparison between FIG. 3 (prior art) and FIG. 8 according to the invention both representing the case where the diameter of the support roll is at a maximum, the diameter of the working roll minimum, shows that the problems of mechanical interference and jet obstructions are solved,
- a comparison between FIG. 4 (prior art) and FIG. 10 (according to the invention) both representing the case where the diameter of the support roll is minimum, the diameter of the working roll maximum, shows that the problems of risk of mechanical interference are reduced.

Thus and in general terms and according to an advantageous embodiment, the diameter of the support roll SR being between a maximum diameter and a minimum diameter, a method in which a nominal diameter is defined, less than the maximum diameter and greater than the minimum diameter and wherein:

- a first rolling configuration is maintained (without readjustment step) as long as the diameter of the support roll is between the maximum diameter and the nominal diameter,
- a second rolling configuration is obtained, when the support roll is at the nominal diameter, to within a tolerance, by performing the readjustment step with reduction in the dimension separating the axis $A_{SR}$ of said support roll SR and the axis $A_{SSR}$ of said side support roller SSR,
- said second configuration obtained by the readjustment step as long as the diameter of the support roll is between the nominal diameter is maintained as long as the diameter of the support roll is between the nominal diameter and the minimum diameter.

It will be noted that the invention also makes it possible to considerably reduce the risks of mechanical interference between the strip and the assembly consisting of bearing support and side support roller on the one hand, or between the assembly consisting of bearing support and side support roller and the support roll on the other hand.

As can be seen in FIGS. 5 to 10, and keeping the interspace It1 between the support roll and the side support roller greater than or equal to a lower limit Δmin1, the invention also makes it possible to provide optimise cooling of the contact between support roll SR and working roll by direct spraying of the working roll, throughout operation, whatever the diameter of the working roll and the diameter of the support roll, and without risk of complete interruption of the jet during such operation.

Advantageously, the rolling mill may thus have at least spray nozzles SN1, SN2 allowing cooling by spraying of at least one jet of fluid on at least part of the strip ST and at least part of said rolls and in which method a cooling step is implemented, comprising at least one direct spraying of at least part of the working rolls WR, on either side of said plane perpendicular to the travel direction of the strip, said nozzles SN1, SN2 being configured to:

- produce a jet J1 directed towards the working roll WR, from at least one side of the plane perpendicular to the direction of travel, the jet passing through said first interspace It1 between the side support roller SSR and the support roll SR, before reaching said working roll WR, and/or
- produce a jet J2 directed towards the working roll WR, from at least one side of the plane perpendicular to the direction of travel, passing through the interspace between the strip and the side support roller, before reaching said working roll and/or the strip.

For each working roll, a direct spraying can thus be implemented on either side of the clamping plane. The nozzles SN1 and SN2 may be carried by the arm A.R. and/or the bearing support B.S.

FIGS. 5 to 10 show an example for which the readjustment step is performed by changing the position of the bearing support BS on the arm AR, and in order to modify (adjust) the dimension separating the axis $A_{SR}$ of said support roll SR and the axis $A_{SSR}$ of said side support roller SSR.

Other technical solutions can be envisaged without departing from the scope of the invention, and still with the objective of modifying (adjusting) the dimension separating the axis $A_{SR}$ of said support roll SR and the axis $A_{SSR}$ of said side support roller SSR.

According to another embodiment, said bearing support BS being fixedly mounted on an arm AR itself articulated on said articulation axis A1 parallel to said support roll providing the pivoting of said bearing support about said articulation axis A1, and in said adjustment of the dimension separating the axis of said support roll and the axis of said side support roller implemented during the step of readjustment is performed by a step of adjusting the position of said articulation axis A1 on the support arm AR.

For example, an eccentric Ex1 may be provided between the articulation axis A1 and said arm AR, and wherein the adjustment of the dimension separating the axis $A_{SR}$ of said support roll SR and the axis $A_{SSR}$ of said side support roller SSR implemented during the readjustment step is performed by a step of rotation of said eccentric Ex1.

Such an embodiment is illustrated in FIG. 11, illustrating respectively in solid lines and in broken lines the change in position of the arm and of the bearing support in two positions of the eccentric Ex1. It is observed that, when the eccentric Ex1 is rotated, the position of the axis A1 remains unchanged, whereas the arm AR and the bearing support BS move away from the axis of the support roll SR.

According to another embodiment, said articulation axis A1 around which the bearing support BS is mounted is supported and mounted on said axis support AS and in which method said adjustment of the dimension separating the axis $A_{SR}$ of said support roll SR and the axis $A_{SSR}$ of said side support roller SSR implemented during the readjustment step is performed by a step of modifying the position of said articulation axis A1 on said axis support AS.

For example, said step of modifying the position of said articulation axis on said axis support AS is obtained by adding or removing shims between the axis support and said articulation axis (example not illustrated), or said step of modifying the position of said articulation axis on said axis support is obtained by rotating an eccentric Ex2 provided between said articulation axis A1 and said axis support AS.

This latter embodiment with eccentric Ex2 is illustrated in FIG. 12, illustrating respectively in solid lines and in broken lines the change in position of the arm and of the bearing support in two positions of the eccentric Ex2. According to this schematic example, the support roll SR is mounted rotatably at chocks Ep, said articulation axis A1 being fixed at the ends thereof to two chocks of the support roll that constitute the axis support AS. An eccentric Ex2 is provided between each end of the articulation axis A1 and the chock Ep. As can be seen in FIG. 12, the rotation of the eccentric Ex2 makes it possible to modify the position of the articulation axis A1 on the axis support AS.

Again, and according to a fourth possible embodiment, said support roll SR is supported at the ends thereof by chocks Ep, and in which method said adjustment of the dimension separating the axis $A_{SR}$ of said support roll SR and the axis $A_{SSR}$ of said side support roller SSR implemented during the readjustment step is performed by a step of modifying the position of the axis $A_{SR}$ of said support roll with respect to the Maes blocks MB intended for cambering the support roll.

For example, and according to the embodiment illustrated in FIG. 13, the support roll SR mounted rotatably on chocks Ep, each of the chocks being in engagement with a Maes block MB. Each bearing support BS is mounted on an arm AR articulated on the axis A1 on the axis support AS formed here by the Maes block MB.

It should also be noted that the chocks Ep are asymmetric, in that they make it possible to obtain two positions of mounting the support roll, with offset of the axis $A_{SR}$ of the support roll depending on whether the chock is mounted in a first mounting direction in the Maes block, or in the second mounting direction, obtained by turning over the chock Ep.

According to this embodiment, the adjustment during the readjustment step is obtained by turning over the block through 180°.

The invention also relates to a mill for rolling a strip ST suitable for implementing the method. Said rolling mill includes at least one cage comprising:

- a pair of working rollers WR with parallel axes, between which the strip ST travels, each of said working rolls having at least one generatrix for contact with the strip,
- a plane perpendicular to a direction of travel of the strip, wherein at least one contact generatrix and said axes of said working rolls WR are situated,
- a pair of support rolls SR, with axes parallel to the plane of the strip and situated on either side of said strip, said support rolls and working rolls situated on the same side of the strip being in contact with each other along a common support generatrix in order to transmit to the working rolls a rolling force substantially normal to the strip,
- two pairs of side support rollers with parallel axes, said rolls in the same pair being situated symmetrically on either side of one of said working rolls, in a plane parallel to the strip, so that each of the side support rollers SSR in the same pair is able to transmit, along a bearing generatrix of said working roll WR, a force allowing holding in a given position relative to the support roll SR,
- a support of each of said support rollers by means of two rows formed by a plurality of support rollers G mounted side by side, making it possible to maintain the side support rollers SSR in a given position,
- a support of each of the two rows formed by said plurality of support rollers, by means of a bearing support BS carrying the two rows of rollers, said bearing support BS being mounted pivotally on an articulation axis A1, parallel to the support roll, carried by an axis support AS, fixed with respect to the axis of the support roll, such as the chocks Ep of the support roll, or the Maes blocks MB intended for cambering the support roll.

Such a mill comprises, during the rolling of the metal strip, a first interspace It1 defined between the side support roller SSR and the support roll S and a second interspace It2 defined between the strip ST and the assembly consisting of side support roller SSR and bearing support BS liable to vary during rolling because of reductions in diameters of the support roll and of the working roll caused by wear or planing of the cylinders.

According to the invention, said mill comprises an adjustment device configured to adjust the dimension of said first interspace It1 and of the dimension of the second interspace It2 by implementing an adjustment of the dimension separating the axis $A_{SR}$ of said support roll SR and the axis $A_{SSR}$ of said side support roller SSR defining, with the support roll, said first interspace It1.

The mill may comprise a device configured for cooling by spraying at least one jet of fluid on at least one part of the strip and at least one part of said rollers, comprising at least one nozzle system with nozzles SN1, SN2 configured to:

- produce a jet J1 directed towards the working roll, from at least one side of the plane perpendicular to the travel direction, the jet passing through a first interspace It1 between the side support roller SSR and the support roll SR, before reaching said working roll WR, and/or
- produce a jet J2 directed towards the working roll, from at least one side of the plane perpendicular to the direction of travel, passing through the interspace between the side support roller SSR and the strip ST, before reaching said working roll and/or the strip.

According to one embodiment, the adjustment device comprises said bearing support BS that is fixedly mounted removably on an arm AR, with an adjustable position on the arm, said arm itself being articulated on said articulation axis parallel to the support roll SR providing the pivoting of said bearing support BS about said articulation axis. The adjustment device is configured so that the adjustment of the dimension separating the axis $A_{SR}$ of said support roll SR and the axis $A_{SSR}$ of said side support roller SSR is performed by modifying the position of said bearing support BS on the arm AR.

For example, and according to the example in FIGS. 5 to 15, the adjustment device comprises a removable fixing means between said bearing support and said arm comprising a groove/key positive-location system 1, said key and said groove carried respectively by said bearing support and said arm, or vice versa, said key or the groove carried by the bearing support BS being offset in the longitudinal direction of the arm, with respect to the plane, parallel to the side support roller, passing through the median line Md to the segment perpendicular to the side support roller joining the two axes of two rows of rollers. The adjustment device is configured so that said adjustment of the dimension separating the axis of said support roll and the axis of said side support roller is carried out by turning over said bearing support BS.

According to another embodiment illustrated by way of indication in FIG. 11, said bearing support BS is mounted fixedly on an arm AR itself articulated on said articulation axis A1 parallel to said support roll providing the pivoting of said bearing support BS about said articulation axis, and wherein the adjustment device is configured so that the adjustment of the dimension separating the axis $A_{SR}$ of said support roll SR and the axis $A_{SSR}$ of said side support roller SSR is performed by adjusting the position of said articulation axis A1 on the arm AR.

Said adjustment device may comprise an eccentric Ex1 provided between the articulation axis A1 and said arm AR, said adjustment device being configured so that said adjustment of the dimension separating the axis $A_{SR}$ of said support roll SR and the axis $A_{SSR}$ of said side support roller SSR is performed by a step of rotating said eccentric Ex1.

According to another embodiment illustrated by way of indication in FIG. 12, said articulation axis A1 about which the bearing support BS is mounted is supported and mounted on an axis support AS and wherein the adjustment device is configured so that the adjustment of the dimension separating the axis AS of said support roll SR and the axis $A_{SSR}$ of said side support roller SSR is performed by modifying the position of said articulation axis A1 on said axis support AS.

The adjustment device may then comprise shims, said adjustment device being configured so that the modification of the position of said articulation axis on said axis support is obtained by adding or removing shims between the axis support and said articulation axis.

Alternatively, said adjustment device comprises the eccentric Ex2 provided between said articulation axis and said axis support AS: said adjustment device is configured so that modification of the position of said articulation axis A1 on said axis support AS is obtained by rotating the eccentric Ex2.

LIST OF COMPONENTS

A1. Articulation axis (between the bearing support BS and the axis support AS)
$A_{SR}$. Axis of the support roll
$A_{SSR}$. Axis of the side support roller
AR. Arm
AS. Axis support
BS. Bearing support
Ep. Chock
Ex1, Ex2. Eccentrics
G. Rollers (bearing support)
IR. Intermediate roll (support roll)
It1. First interspace between the side support roller and the support roll
It2. Second interspace between the assembly consisting of a side support roller and bearing support and the strip
J1. First jet
J2. Second jet
MB. Maes block
Md. Median line
SR. Support roll
SSR. Side supportroller
ST. Strip
WR. Working rolls
1. Groove/key positive-location system

The invention claimed is:

1. A rolling method adapted to a mill for rolling a strip (ST), comprising:

rolling said strip using a pair of working rolls (WR) with parallel axes with said strip being taken between said working rolls (WR) and travelling between the pair of working rolls, each of said working rolls having at least one generatrix of contact with the strip, transmitting a rolling force to said working rolls (WR) using a pair of support rolls (SR), the rolling force being normal to the strip, said working rolls (WR) and said support rolls (SR) being situated on the same side of the strip being in contact with each other along a common support generatrix in order to transmit said rolling force, maintaining the at least one contact generatrix and the axes of said working rolls in a plane perpendicular to a direction of travel of the strip, holding of each of said working rolls (WR) by a pair of side support rollers (SSR), situated on either side of said plane perpendicular to the direction of travel of the strip, each of the side support rollers (SSR) being able to exert, along a bearing generatrix of said working roll (WR), a force holding an axis of the working roll (WR) in a given position with respect to a rolling cage of the mill and with respect to said side support rollers, supporting of each of said side support rollers by means of two rows formed by a plurality of rollers (G) mounted side by side, for holding the side support rollers (SSR) in a given position, supporting each of the two rows formed by said plurality of rollers (G), said supporting being provided by a bearing support (BS) carrying the two rows of rollers (G), wherein said bearing support (BS) is mounted pivotably by a support arm (AR) on an articulation axis (A1), the articulation axis (A1) being parallel to the support roll (SR), said providing a support including pivoting of the bearing support (BS) around said articulation axis (A1), wherein the support roll (SR) is carried by an axis support (AS) formed by chocks (Ep), or Maes blocks (MB) cambering the support roll, said axis support (AS) being fixed with respect to the axis of the support roll (SR), wherein dimensions of a first interspace (It1) defined between the side support roller (SSR) and the support roll (SR) and a second interspace (It2) defined between the strip (ST) and the assembly consisting of the side support roller (SSR) and the bearing support (BS) vary during rolling because of reductions in diameters of the support roll and working roll caused by wear and planing of the support and working rolls, and a readjustment step of adjusting the dimensions of said first interspace (It1) and of the second interspace (It2) by carrying out an adjustment of the dimension separating an axis ($A_{SR}$) of said support roll (SR) and the axis ($A_{ssR}$) of said side support roller (SSR), said readjustment step being distinct and additional to the pivoting of the bearing support (BS) around said articulation axis (A1), wherein said bearing support (BS) is fixedly mounted removably on said support arm (AR), with an adjustable position on the support arm, wherein said adjustment of the dimension separating the axis of said support roll (SR) and the axis of said side support roller (SSR) implemented during the readjustment step is performed by a step of modifying the position of said bearing support (BS) on the length of said support arm (AR), said readjustment step being configured to change the dimension of the first interspace for a same first diameter of each of the working rolls (WR), a same second diameter of each of the side support rollers (SSR), and a same third diameter of each of the support rolls (SR), said first interspace being determined when said working roll (WR) is held by said pair of side support rollers (SSR).

2. The method according to claim 1, wherein said readjustment step consists of adjusting the dimension separating the axis of said support roll (SR) and the axis of said side support roller (SSR) so that the dimension of the first interspace is at least equal to a lower limit Δmin1 and the dimension of the second interspace is at least equal to a lower limit Δmin2, said lower limit Δmin1 and the lower limit Δmin2 being greater than or equal to 5 mm.

3. The method according to claim 1, wherein the diameter of the support roll (SR) is between a maximum diameter and a minimum diameter, further comprising defining a nominal diameter smaller than the maximum diameter and larger than the minimum diameter, said defining step comprising:

maintaining a first rolling configuration without the readjustment step so long as the diameter of the support roll lies between the maximum diameter and the nominal diameter, obtaining a second rolling configuration, when the support roll is at the nominal diameter, by performing said readjustment step with reduction of the dimension separating the axis ($A_{SR}$) of said support roll (SR) and the axis ($A_{SSR}$) of said side support roller (SSR), maintaining said second configuration obtained by said readjustment step as long as the diameter of the support roll lies between the nominal diameter and the minimum diameter.

4. The rolling method according to claim 1, further comprising:

using at least spray nozzles (SN1, SN2) to provide cooling by spraying of at least one jet of fluid onto at least part of the strip (ST) and at least part of one of said working rolls; and implementing a cooling step comprising at least one direct spraying of at least part of the working rolls (WR), on either side of said plane perpendicular to the direction of travel of the strip, said nozzles (SN1, SN2) producing:

a jet (J1) directed towards the working roll (WR), from at least one side of the plane perpendicular to the direction of travel, the jet passing through said first interspace (It1) between the side support roller (SSR) and the support roll (SR), before reaching said working roll (WR), and/or a jet (J2) directed towards the working roll (WR), from at least one side of the plane perpendicular to the direction of travel, passing through the second interspace between the strip and the side support roller, before reaching said working roll and/or said strip.

5. The method according to claim 1, wherein the mill comprises a removable means of fixing between said bearing support (BS) and said support arm (AR), the means of fixing comprising a groove/key positive-location system (1) comprised of a key and a groove carried respectively by said bearing support (BS) and said support arm (AR), or vice versa, said key or the groove carried by the bearing support being offset in the longitudinal direction of the support arm (AR) with respect to a plane i) parallel to the side support roller, ii) passing through a median line (Md) to a segment which is perpendicular to the side support roller, said segment joining the two axes of the two rows of the rollers (G) mounted side by side for holding the side support rollers (SSR), and wherein, during the readjustment step, said adjustment of the dimension separating the axis of said support roll and the axis of said side support roller is performed by a step of turning over said bearing support (BS) on the support arm.

6. The method according to claim 1, wherein said readjustment step is implemented when rolling is interrupted, after planing of the working roll and/or of the support roll.

7. A mill for rolling a strip (ST) including at least one cage, comprising:

a pair of working rolls (WR) with parallel axes, between which the strip (ST) passes, each of said working rolls having at least one generatrix of contact with the strip, trip, wherein at least one contact generatrix and the axes of said working rolls (WR) are situated, a pair of support rolls (SR), with axes parallel to a plane of the strip and situated on either side of said strip, said support rolls and working rolls situated on the same side of the strip being in contact with each other along a common support generatrix in order to transmit to the working rolls a rolling force normal to the strip, two pairs of side support rollers with parallel axes, said side support rollers in the same pair being situated symmetrically on either side of one of said working rolls, in a plane parallel to the strip, so that each of the side support rollers (SSR) in the same pair is able to transmit, along a bearing generatrix of said working roll (WR), a force affording holding in a given position in relation to the support roll (SR), a support for each of said support rollers by means of two rows formed by a plurality of support rollers (G) mounted side by side, for holding the side support rollers (SSR) in a given position, a bearing support (BS) providing support of each of the two rows formed by said plurality of support rollers by said bearing support (BS) carrying the two rows, said bearing support (BS) being mounted pivotally by a support arm (AR) on an articulation axis (A1), the articulation axis (A1) being parallel to the support roll, wherein the support roll (SR) is carried by an axis support (AS) formed by chocks (Ep) or Maes blocks (MB), said axis support (AS) being fixed with respect to the axis of the support roll, wherein the mill comprises, during the rolling of the strip, a first interspace (Itl) defined between the side support roller (SSR) and the support roll (SR) and a second interspace (It2) defined between the strip (ST) and the assembly consisting of the side support roller (SSR) and the bearing support (BS) vary during rolling because of the reductions in diameters of the support roll and of the working roll caused by wear or planing of the support and working rolls, and an adjustment device configured to adjust the dimensions of said first interspace (It1) and the dimension of the second interspace (It2) using an adjustment of the dimension separating the axis (AsR) of said support roll (SR) and the axis (AssR) of said side support roller (SSR), the adjustment being distinct and additional to the pivoting of the bearing support (BS) around said articulation axis (AS), wherein the adjustment device comprises said bearing support (BS) that is fixedly mounted removably on said support arm (AR), with a position adjustable on the support arm, and wherein the adjustment device is configured so that the adjustment of the dimension separating the axis (ASR) of said support roll (SR) and the axis (ASSR) of said side support roller (SSR) is performed by modifying the position of said bearing support (BS) on the support arm (AR), said adjustment device being configured to change the dimension of the first interspace for a same first diameter of each of the working rolls (WR), a same second diameter of each of the side support rollers (SSR), and a same third diameter of each of the support rolls (SR), said first interspace being determined when said working roll (WR) is held by said pair of side support rollers (SSR).

8. The mill according to claim 7, comprising a device configured for cooling by spraying at least one jet of fluid on at least part of the strip and at least part of one of said working rolls, comprising at least one system of nozzles with nozzles (SN1, SN2) configured to:

produce a jet (J1) directed towards the working roll, from at least one side of the plane perpendicular to the direction of travel, the jet passing through the first interspace (Itl) between the side support roller (SSR) and the support roll (SR), before reaching said working roll (WR), and/or produce a jet (J2) directed towards the working roll, from at least one side of the plane perpendicular to the direction of travel, passing through the second interspace between the side support roller (SSR) and the strip (ST), before reaching said working roll and/or the strip.

9. The mill according to claim 7, wherein the adjustment device comprises a removable means of fixing between said bearing support and said support arm, the means of fixing comprising a groove/key positive-location system (1) comprised of a key and a groove carried respectively by said bearing support and said support arm, or vice versa, said key or the groove carried by the bearing support (BS) being offset in the longitudinal direction of the support arm with respect to a plane i) parallel to the side support roller, ii) passing through a median line (Md) to a segment, said segment being perpendicular to the side support roller, said segment joining the two axes of the two rows of the rollers (G) mounted side by side for holding the side support rollers (SSR), and wherein the adjustment device is configured so that said adjustment of the dimension separating the axis of said support roll and the axis of said side support roller is performed by turning over said bearing support (BS).

* * * * *